US012270197B1

(12) United States Patent
Williams

(10) Patent No.: US 12,270,197 B1
(45) Date of Patent: Apr. 8, 2025

(54) METHOD AND APPARATUS FOR FLOOD REMEDIATION

(71) Applicant: Derrick Williams, Kingwood, TX (US)

(72) Inventor: Derrick Williams, Kingwood, TX (US)

( * ) Notice: Subject to any disclaimer, the term of this patent is extended or adjusted under 35 U.S.C. 154(b) by 298 days.

(21) Appl. No.: 17/958,512

(22) Filed: Oct. 3, 2022

(51) Int. Cl.
*E04B 1/76* (2006.01)
*E04B 2/74* (2006.01)

(52) U.S. Cl.
CPC ..... *E04B 1/7604* (2013.01); *E04B 2/7412* (2013.01)

(58) Field of Classification Search
CPC .... E04B 1/7604; E04B 2/7412; E04B 2/7457; E04B 2/562; E04B 2/7409
See application file for complete search history.

(56) References Cited

PUBLICATIONS

Patricia Skinner "Floodproofing Improvements for Walls and Floors" Oct. 13, 2012 https://www.Isuagcenter.com/topics/family_home/home/design_construction/design/remodeling%20renovation/preventing%20flood%20damage/floodproofing-improvements-for-walls-and-floors (Year: 2012).*
Superior Restoration and Shamrock Cleaning Sep. 1, 2015 https://www.youtube.com/watch?v=IqVEKCreltw (Year: 2015).*
City of Phoenix in Oregon, Building with Flood Damage Resistant Materials, USA, available at: https://www.phoenixoregon.gov/buildingplanning/page/building-flood-damage-resistant-materials.
Building Performance Institute, Inc., Flood Damage Prevention Tips for Homeowners, USA, dated Mar. 26, 2019, available at https://www.bpihomeowner.org/blog/flood-damage-prevention-tips-homeowners-0.
Houzz.com Forums, discussion thread, USA, available at https://www.houzz.com/discussions/5962687/basement-wall-cement-board.
FEMA, Flood Damage-Resistant Materials Requirements, Technical Bulletin 2, Aug. 2008, USA, available at https://www.fema.gov/sites/default/files/2020-07/fema_tb_2_flood_damage-resistant_materials_requirements.pdf.
Green Building Advisor, Community and Q&A, Insulating Basement in Flood Plain, USA, available at https://www.greenbuildingadvisor.com/question/insulating-basement-in-flood-plain.
Louisiana State University (LSU), Flood Safe Home, Freeboard Project, USA, available at https://floodsafehome.lsu.edu/freeboardproject.
ProTradeCraft.com, Flood Resistant Wall Assembly, Youtube.com Video, USA, available at https://www.youtube.com/watch?v=1Sa834rxm00.

(Continued)

*Primary Examiner* — Patrick J Maestri
(74) *Attorney, Agent, or Firm* — Compton & Associates PLLC

(57) ABSTRACT

An apparatus, structure, and method are disclosed for flood remediation of a residential or commercial structure. The flood remediation apparatus, structure, and method may include forming foam insulation in a certain shape within a wall and using modified cement boards instead of traditional drywall. Forming the foam insulation in a certain shape, such as the shape of a rut or cavity, will provide a channel to allow water from a flood event to flow out and air to flow into the interior of a wall. Using modified cement boards in place of drywall allows airflow to travel to the interior portion of the wall and is a more durable material that can be dried, cleaned, and reattached onto the wall once all interior surfaces that came in contact with flood waters are completely dried. In other embodiments, the cement boards may be left on the wall. In some embodiments, drying behind a cement board wall is facilitated with a portable fan blower adapter.

20 Claims, 21 Drawing Sheets

(56) References Cited

PUBLICATIONS

LSU AgCenter Research & Extension, Pub. 2771 Wet Floodproofing: Reducing Damage from Floods, USA, available at https://www.lsuagcenter.com/~/media/system/0/e/5/3/0e53e95f265631469d0ce2be5aaf0187/pub2771wetfloodproofinghighres.pdf.
LSU AgCenter Research & Extension, Claudette H. Reichel, Joseph D. Bankston, Jr., & Patricia Skinner, Wet Floodproofing Webpage, USA, available at https://www.lsuagcenter.com/topics/family_home/hazards_and_threats/publications/wet-floodproofing.
LSU AgCenter Research & Extension, LaHouse website, USA, accessible through https://www.lsuagcenter.com/topics/family_home/home/lahouse/lahouse.
Claudette H. Reichel, Louisiana House, Resilient Home Solutions, Youtube.com video, USA, available at https://www.youtube.com/watch?v=992VPbX_9Jw.
JamesHardie.com, FEMA Letter, USA, available at https://www.jameshardie.com/jameshardiemainsite/media/site-documents/technicaldocuments/reports/fema.pdf.

* cited by examiner

METHOD AND APPARATUS FOR FLOOD REMEDIATION

FIELD OF THE INVENTION

The present invention generally relates to the field of flood damage prevention and remediation.

BACKGROUND OF THE INVENTION

Homes, office buildings, and other structures may experience flooding due to various issues impacting the drainage of water such as high river sedimentation, commercial & residential building in previously forested areas, or simply receiving large amounts of rains in areas not used to or prepared for such. Some flood prone structures may go through a flood remediation process repeatedly over the course of time. This often leads to significant monetary expenses and may also negatively affect the mental well-being of the owners of the structures, e.g., residential homeowners.

Current household walls are created using dry wall and fiberglass insulation both which get destroyed when a flood event happens. In addition to the tear down and out of these "normal" walls, there is a drying out process that is usually undertaken using high powered fans and dehumidifiers. This process is time consuming and is destined to be repeated over and over again depending on the location of the home in the flood plain. There is also the added concern of insurance costs and coverage. Some flood damaged homes will be newly affected and so may not be covered by insurance or have low coverage amounts leaving the homeowner in a poor financial position.

Currently, the United States Federal Emergency Management Agency ("FEMA") suggests using flood hardy building materials that can either resist moisture or be easily and affordably replaced. However, for individuals who reside in houses that are located in flood zones or areas prone to flooding events, constant rebuild and repair can be very costly and time consuming and can lead to severe mental distress. Present solutions to mitigating these expenses and/or emotional burdens are unsatisfactory. New solutions are needed to help individuals and businesses adapt to current and future flooding risks.

SUMMARY OF THE INVENTION

The present invention concerns a new and unique process of flood remediation for a typical residential or commercial structure using traditional building materials already in mass production to create an improved structure that is resilient in the face of a flood event and its aftermath. In some embodiments, cement board material combined with foam insulation provides a wall that is insulated and sturdy in design and has an appearance similar to a wall constructed with dry wall and fiberglass insulation.

The process in some embodiments may include modifying the cement board and/or forming the foam insulation in the framing of the walls so that the internal portions of the walls let water and/or debris from a flood event to flow out of the walls and allow airflow to enter the wall to ventilate the inside of the wall until dry. To reduce the major costs of flood remediation, the process in some embodiments also involves using cement board, either in part or in whole, to replace drywall as a wall material. Baseboards may also be used to cover any weep holes at the base of a wall. When a flood event occurs, the baseboards can be removed, water and moisture will be able to flow out of the weep holes and onto the floor to allow airflow into the interior of the wall. In some circumstances, the cement boards are removed to facilitate drying. In circumstances where the cement boards are not removed, embodiments with a portable blower fan adapter may increase the rate of drying.

In the event the same structure experiences a major flood event multiple times, the above-described methods and structures and apparatuses may prevent, or reduce the cost of, major demolition of the walls, floors and ceiling and may save hundreds or thousands of dollars in repairs for both the owner and insurance companies.

DETAILED DESCRIPTION

Figure 1:
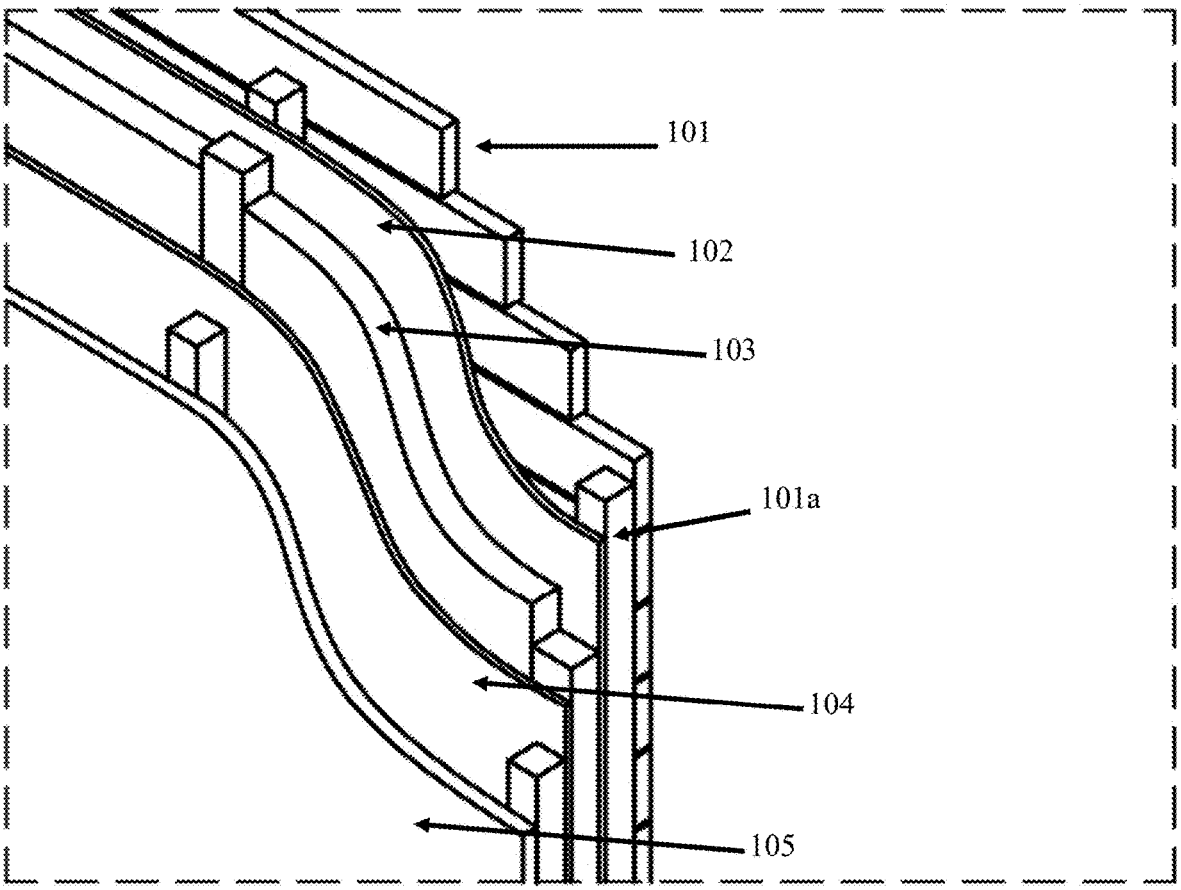
Fig. 1 Prior Art
FIG. 1 is an approximate representation of exterior wall layers for a building having lap siding prior to the application of cavity insulation and drywall.

The present invention is described with reference to the attached figures. The figures are not necessarily drawn to scale. Several aspects of embodiments of the invention are described below. It should be understood that numerous specific details, relationships, and methods are set forth to provide an understanding of the invention. One skilled in the relevant art, however, will readily recognize that the invention can be practiced without one or more of the specific details or with other methods.

As an initial matter, the flood remediation process for a typical residential structure using traditional building materials such as wood studs, gypsum drywall, carpet, and tile may proceed approximately as follows. Once flood water has sufficiently receded from the residential structure, the demolition process begins. The demolition process typically includes removing damaged household goods and damaged materials from the home in order to start the process of drying the structure out as soon as possible.

Wet and damaged furniture and household goods are typically removed first. Afterwards, carpeting and any associated carpet padding are removed. Ceramic tile and/or its underlayment (mortar and thin-set) may also need to be removed, but in some circumstances its removal may be delayed or not necessary. Other types of flooring like vinyl and linoleum may also need to be removed. The general underlying principle is to remove flooring after a flood if it's physical structure(s) may have been compromised by water exposure or the flooring's exposure to water means it is likely to foster the growth of mold. Sometimes flooring must also be removed to facilitate the demolition of other parts of the building or simply for convenience or as part of a larger remodeling plan.

In addition to the removal of flooring, walls must typically be demolished in whole or in part. Wall demolition typically involves removing and disposing of some or all drywall, insulation, baseboards, molding, and other material that flood water has compromised. If flood water has damaged the ceiling, these materials should also typically be removed from the ceiling. Once the compromised materials have been removed from the walls, ceilings, and floors, the house's wooden frame will typically be exposed. Sometimes plywood or water-vulnerable layers between studs and the exterior (e.g., the lap siding, stucco, brick veneer, or brick facade) must be removed in whole or in part. Unused nails in the wooden frame should also be pulled from the frame studs.

Fans and humidifiers are often brought in to dry out the studs and any remaining moisture left behind by the flood water to prevent mold or bacteria from growing in a damp environment. Typical drying time is often around 72-hours. For flood events that are large in scale or duration, more time may be needed to dry out any remaining moisture in the structure. If mold has already begun to grow, appropriate mold remediation methods to remove the mold and/or stop future mold growth should also be implemented. Once the demolition process is complete, the building is typically similar to the depiction of FIG. 1 or FIG. 2.

FIG. 1 depicts some of the layers (not necessarily to scale) of materials in a typical residential building with lap siding (e.g., Hardie® Plank or wood). Item 101 is lap siding, sometimes furring strips (101*a*) or studs are present under the lap siding. Item 102 is weather resistant barrier, typically plastic house wrap or asphalt felt (tar paper) or Grade D building paper, which is used to reduce air infiltration and water penetration from the exterior. Depending on the climate or construction preferences sometimes additional layers (not shown) can be added, or used as a replacement, such as an air barrier, a moisture barrier, and/or a vapor barrier. Various forms of insulation 103 may also be present, such as continuous insulation, closed cell foam sheets, rigid foam, spray foam, etc., typically between the framing and the lap siding. The location of the insulation 103 relative to the weather resistant barrier 102 and sheathing 104 depends on construction preferences and various climate factors. Item 104 is sheathing, typically oriented strand board (OSB) or plywood. Item 105 is framing, typically wood, but other materials such as metal, concrete, cement block, bamboo, or structural insulated panels may be used.

Figure 2:
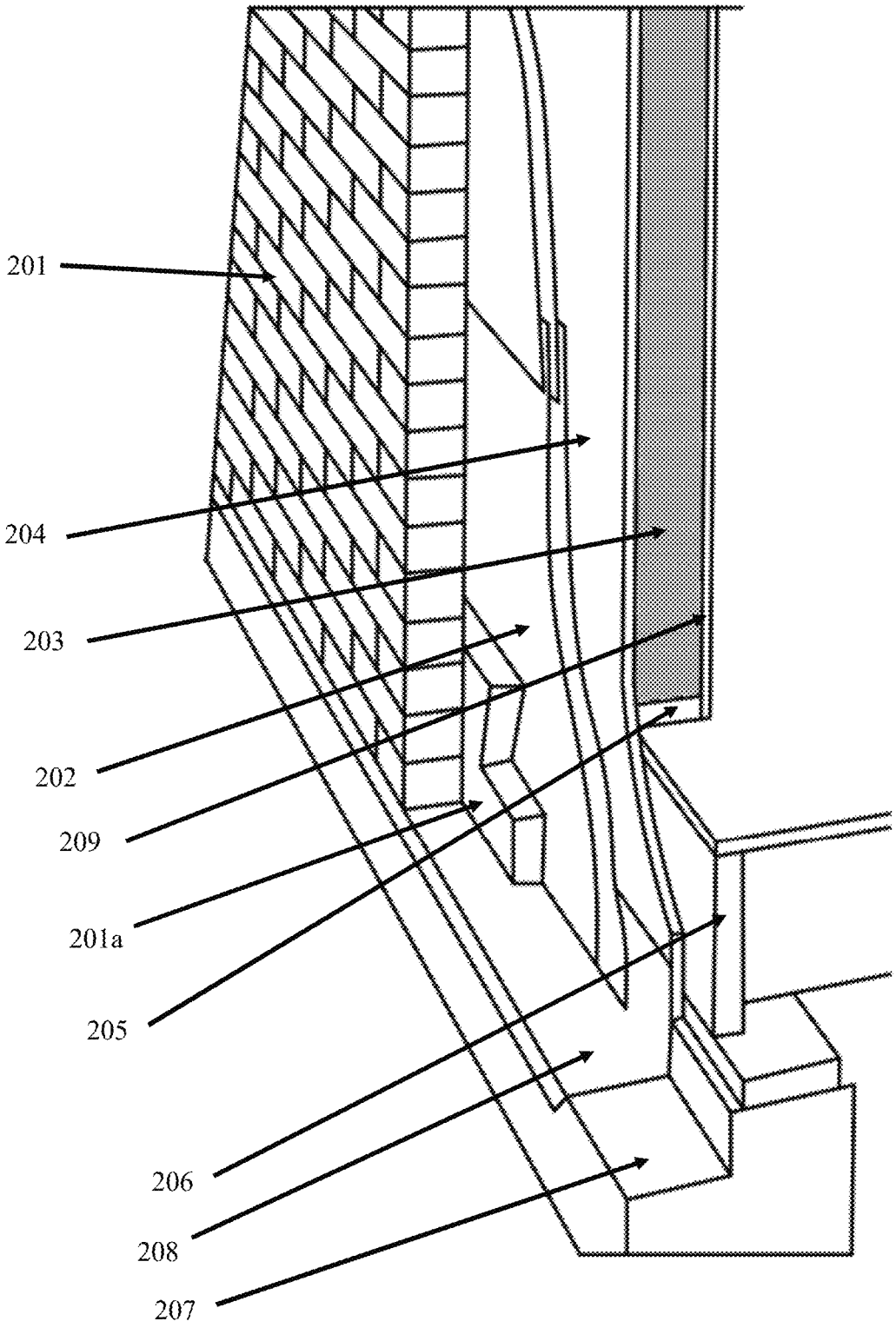
Fig. 2 Prior Art
FIG. 2 is an approximate representation of exterior wall layers for a building having brick or cement block exterior prior to the application of cavity insulation and drywall.

FIG. 2 depicts the layers of materials in a typical residential building with a brick exterior. Item 201 are bricks (or, in some instances, cement blocks) which form an exterior wall. Masonry ties to secure the veneer to the building and mortar mesh/mortar net (201*a*) to stop weephole blockage from mortar may also be present. Item 202 is a two-layered weather resistive barrier, similar to item 102. Item 203 is fiberglass insulation, similar to item 103. Item 204 is sheathing, similar to item 104. Item 205 is a base plate (floor stud). Item 206 is wood floor framing. Item 207 is a cement foundation. Item 208 is base flashing. Item 209 is drywall.

As explained with respect to FIGS. 1 and 2, additional weather barrier layers (e.g., air, moisture, and/or vapor) may also be present, their position relative to other layers depending on local building standards, construction preferences, and/or the climate. Other layers or materials, including air space such as an insulating air gap, may also be present. Electrical, gas, and plumbing lines and/or outlets may also be present. In some types of construction, no layers other than framing and the exterior wall material (e.g., brick, concrete, lap siding) may be present.

Figure 3:
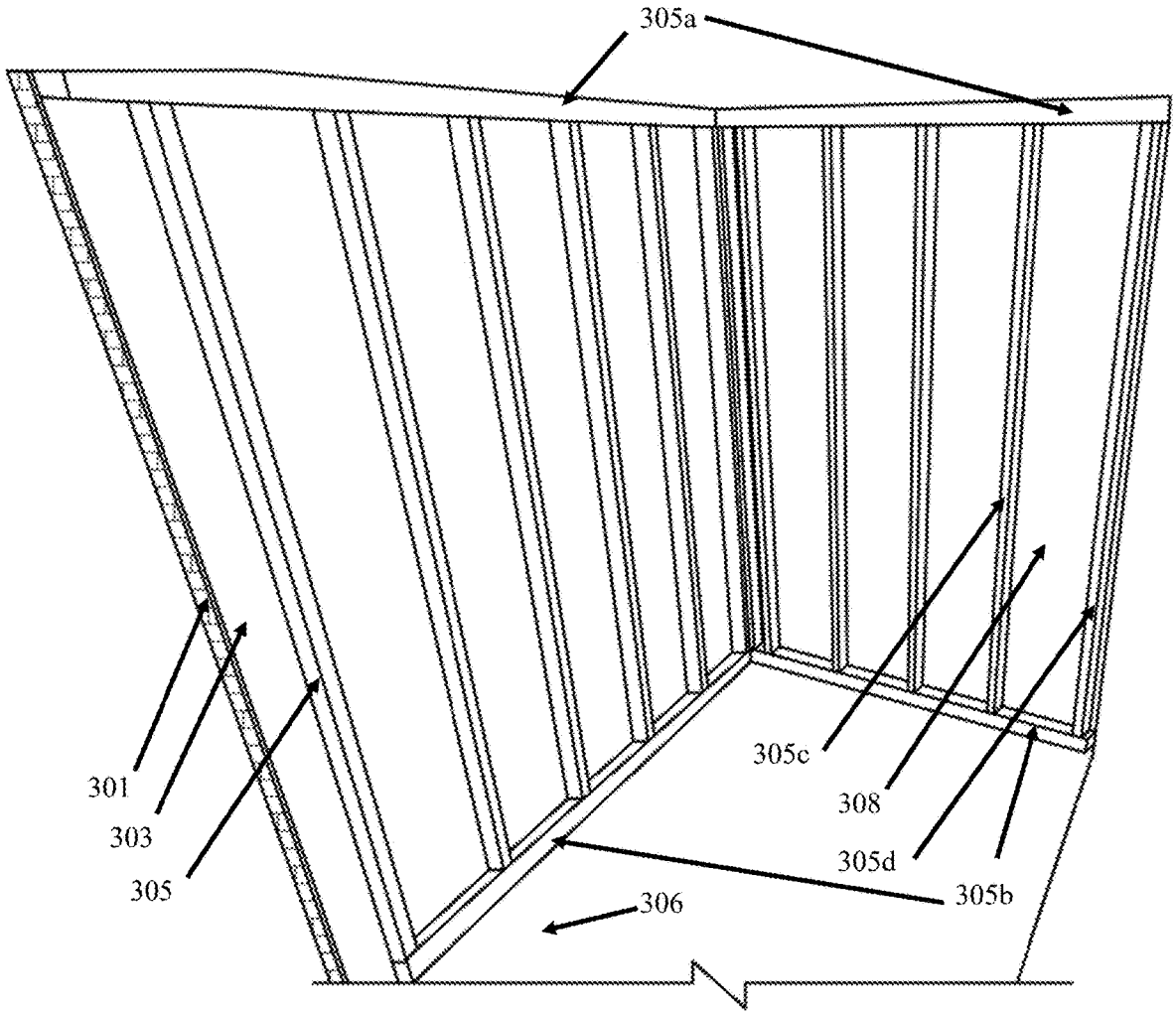
Fig. 3 Prior Art
FIG. 3 depicts an approximate interior view of a residential building looking towards the exterior walls in the context of new construction and/or post-flood demolition . . .

FIG. 3 depicts an approximate interior view of a residential building looking towards the exterior walls in the context of new construction and/or post-flood demolition. The bricks 301 and sheathing 303 and framing 305 are shown. A cement foundation 306 is exposed. In some buildings, there may be multiple, horizontally stacked studs, including what are sometimes called sill plates or sole plates or wall plates or base plates or bottom studs or floor plates or flood studs. Sometimes two studs, or even three of four or more studs (potentially of varying nominal or actual sizes), may be laid horizontally on top of each other. Sometimes only a single stud will be present. Sometimes, no bottom stud may be present. In FIG. 3, a single stud base plate 305*b* is shown.

The framing 305 forms a framing cavity 308 which in FIG. 3 is generally defined by the top plate 305*a*, two vertical framing studs 305*c* and 305*d*, and the base plate 305*b*. Other horizontal framing (not shown), such as those for a door frame or a window, may serve as a bottom or a top of a cavity thereby defining a smaller cavity. Sometimes a framing cavity may have only three sides in a planar view, e.g., the vertical cavity may lack a top such as a top plate and is therefore exposed to the upper levels or attic (or exposed to lower levels if a base plate is lacking). In some embodiments, flooring material or a foundation may serve as the bottom of a framing cavity, and/or the ceiling material as a top of a framing cavity.

Figure 4:
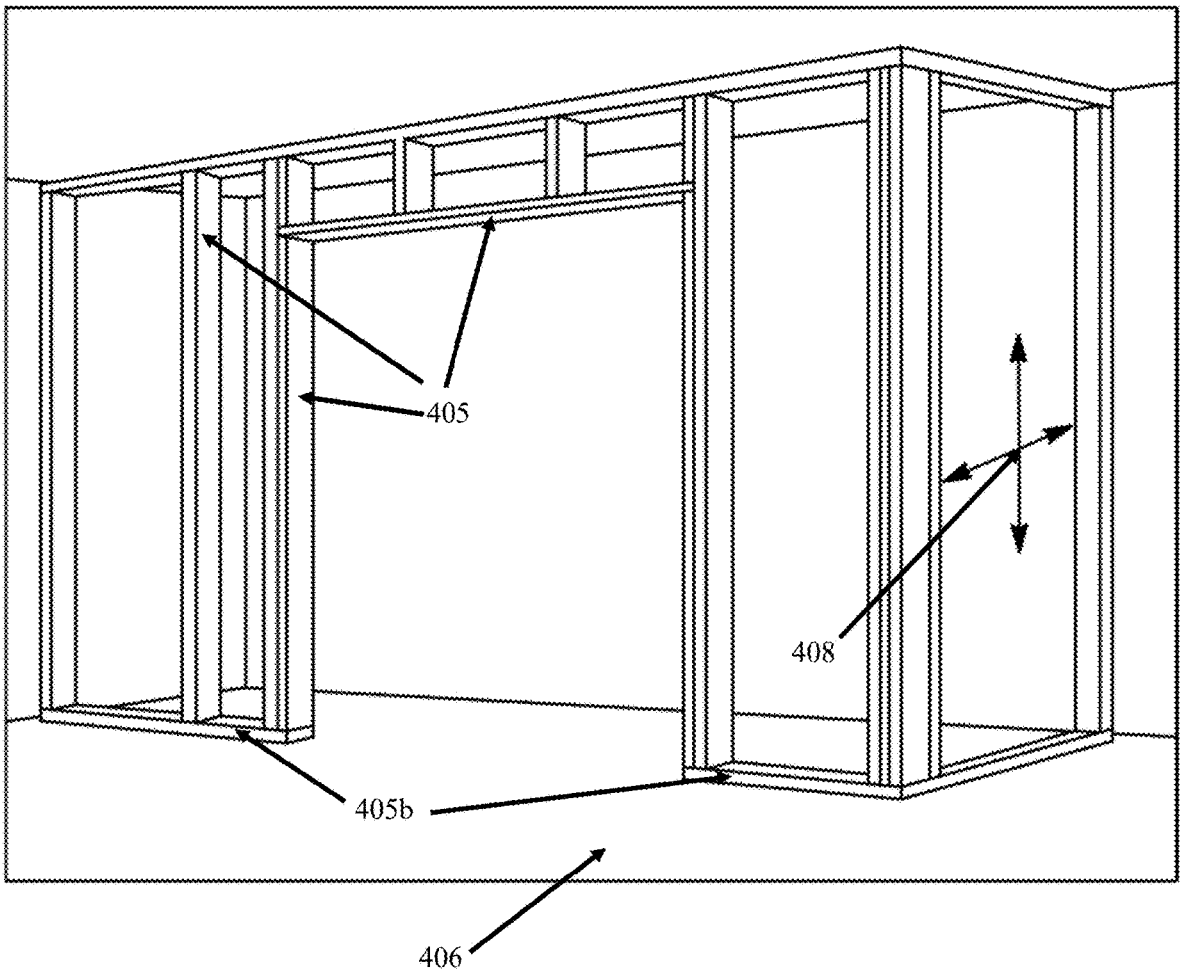
Fig. 4 Prior Art
FIG. 4 depicts an interior view of a residential building with unfinished interior wall framing.

FIG. 4 depicts an interior view of a residential building with unfinished interior wall framing 405. In FIG. 4, a single stud base plate 405*b* is shown. The cement foundation 406 is exposed. Typically, just the framing 405 is present on interior walls prior to the addition of cavity insulation (if any) and/or drywall and trim (e.g., base boards, crown molding) for new construction. A framing cavity 408 is also present.

With respect to post-flood demolition, both FIGS. 3 and 4 approximately depict post-flood demolition where all cavity insulation and drywall up to the ceiling have been removed. Sometimes minor flooding will only necessitate the removal of drywall and cavity insulation on the lower half or the lower third or some specific distance above the high-water mark. In both FIGS. 3 and 4, electrical, gas, and plumbing lines and/or outlets may also be present in both new construction and post-flood demolition but are not shown.

With respect to new construction, FIGS. 1-4 represent an approximate state of construction fit for the application of mold/fungus prevention and/or insect treatments. With respect to post-flood demolition, once the affected areas are sufficiently dried, appropriate mold prevention treatments may be applied. For both new construction and post-flood demolition, in addition to or in place of mold/fungus treatment, a spray that waterproofs or increases the framing's and/or the sheathing's water resistance may be applied, such as oil or water-based wood sealers, or polyurethane coatings. Various anti-corrosion treatments or inhibitors such as epoxies, acrylics, oils, polysiloxane, and/or urethanes are also available for metal framing.

The order of application of water proofing and other mold or insect treatments may vary based on the type(s) used. While generally beneficial, such mold, insect, or waterproofing/resistance treatments may have already been performed. Pressure treated wood (for example, green tinted wood that has been treated with copper) has some rot resistant properties, and yet in some applications may benefit from additional waterproofing and/or sealing treatments. Such treatments may also not be necessary, required, desired, affordable, and/or cost-effective. Costs, climate, risk tolerance, and/or construction preferences may lead to the use or non-use of one or more such treatments.

In the course of new construction and typical post-flood reconstruction, the next steps may typically include the application of internal cavity insulation in the framing along the exterior walls of the house. Such insulation is most often in the form of rigid foam sheets or fiberglass (e.g., faced rolls, unfaced rolls, or blown). Drywall is attached to the framing. The drywall is taped and floated and painted (or wallpapered). Internal and external doors are installed. Flooring (e.g., carpet, tile, linoleum, wood) is then installed. Final trimmings such as baseboards, crown molding, and door trim may be painted and installed. Outlet coverings are installed. The above order is approximately typical, but may vary based on costs, climate, risk tolerance, construction preferences, material availability, labor availability, and other factors.

Once (re) construction efforts are complete, the risk of flooding is still present. Some residential buildings may flood multiple times over the course of a few years due to changing climate and water drainage patterns. Demolition and reconstruction after each flooding event can be very expensive and repeated reconstruction efforts in view of near certain future flooding are not cost-effective. There are many factors that may affect the approach to post-flooding reconstruction of residential and office buildings. This is because flood waters have many different effects on a building, only some of which are discussed here.

Initially, the water itself compromises the physical attributes of the materials in the building. Water dissolves some types of paint and weakens drywall and paper materials used in construction. The water can also weaken or dissolve wallpaper or wallpaper glue. Wood (especially particle board and plywood) exposed to water can begin to break down or attract insects that feed on wet wood. While any exposure to flood water (or even the water vapors from flood waters) may bring about deleterious effects, it's generally the case that the effects worsen with prolonged contact with water or water vapor, and that quickly drying the affected materials is the primary way to mitigate the severity of the harm.

Flood waters also contain more than just water, flood waters contain many different types of debris. For example, flood waters contain mold and fungus and bacteria that can be deposited throughout the building. The post-flood dampness in a building fosters mold and fungal growth which can quickly render a building uninhabitable. Flood waters can also deposit large amounts of dirt, sand, and organic matter (including living or dead creatures such as insects, spiders, small mammals, fish, reptiles, amphibians, birds, and other aquatic or land life) deep into cracks and crevices and cavities and seams throughout a building. These deposits can then decompose or foster the growth of undesirable life-forms. These harms are more challenging to mitigate because while drying may help reduce the severity of the harm, the various types of flood water debris are difficult to entirely remove. Mold and fungus in particular can quickly spread in ways that are difficult to anticipate or detect.

The present invention presents some alternatives to traditional (re) construction in an attempt to address some of the typical flood related issues and to try to offset some of the costs associated with post-flooding reconstruction, especially repeated post-flooding reconstruction. The embodiments discussed herein attempt to prevent, mitigate, and/or allow for better mitigation, of the effects of the exposure to flood waters, humidity, flood water debris, and/or water generally.

In the process of post-flood demolition and reconstruction, fiberglass insulation that has been exposed to water is typically thrown away. The fiberglass insulation will wick, absorb, and/or retain water. It may also act as a net, trapping within it dirt, sand, various living or dead creatures, and/or other organic deposits present in the flood water. The properties that make it act as a good insulator also lead to slow drying times. As such, wet fiberglass insulation typically needs to be extracted and discarded.

Sheet foam insulation, particularly closed cell foam insulation, is generally more resistant to flood waters. While water will compromise some types of foam sheets, other types can readily handle prolonged exposure. But the sheeting nature of the insulation can often impede efforts to circulate air through and around the framing to dry out the building. Thin gaps between the foam sheets and the framing and/or the drywall can also create spaces for the deposition of organic material from the flood waters, leading to mold and insect problems.

Figure 5:
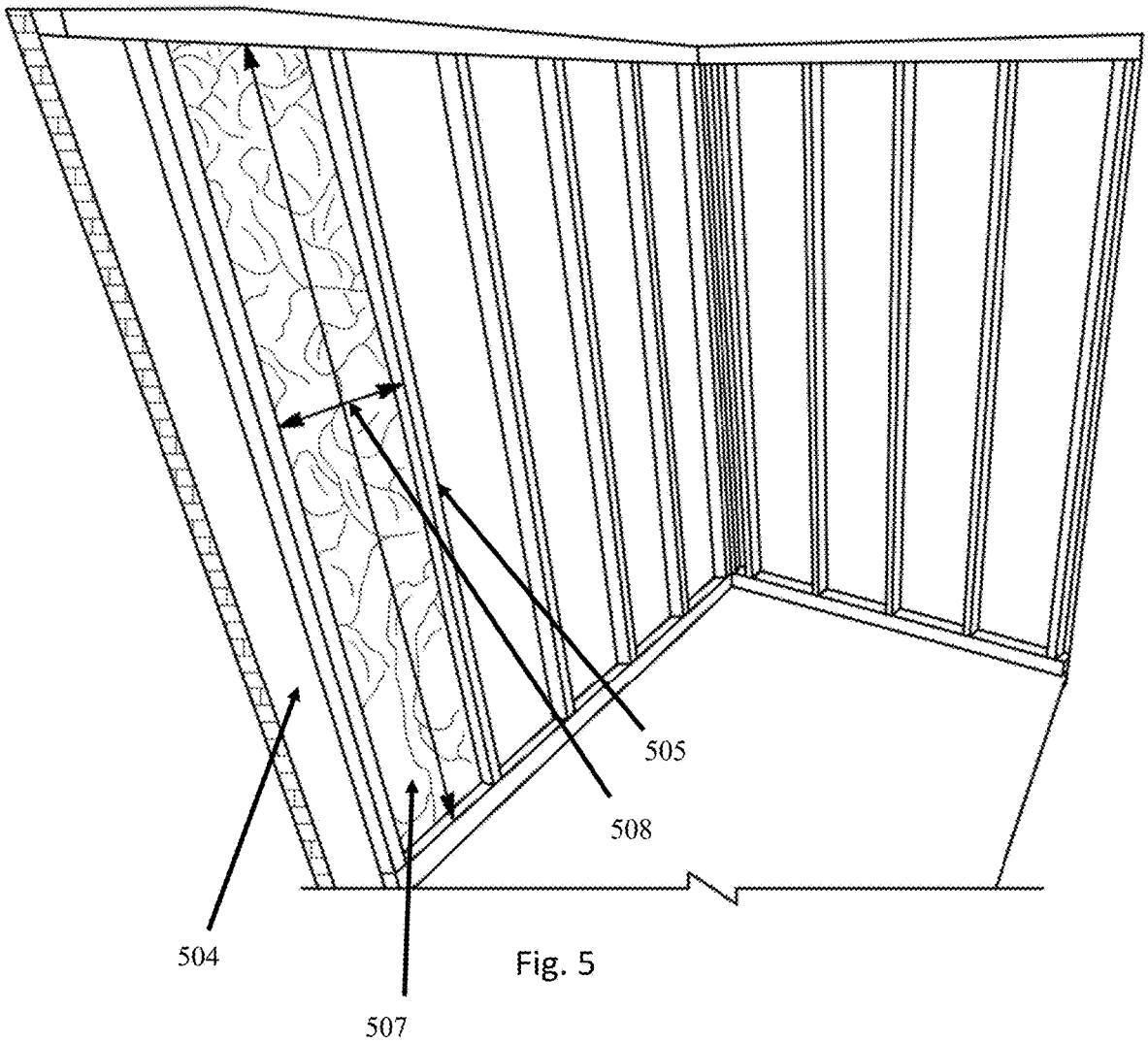
FIG. 5 depicts an embodiment wherein the interior portion of an exterior wall of a building is utilizing closed cell spray foam as a framing cavity insulation.

FIG. 5 depicts an embodiment wherein the interior portion of an exterior wall of a building is utilizing closed cell spray foam 507 as a framing cavity 508 insulation. Closed cell spray foam is typically a polyurethane foam that is spray-applied to a surface. Once cured, it typically has an insulation "R-value" high enough to make it suitable for building insulation. (An R-value is a well-known measure of how well a barrier, such as a layer of insulation, a window, or a complete wall or ceiling, resists the conductive flow of heat.) One advantage of closed cell spray foam is that it is water-resistant and once cured, creates a generally waterproof seal along the surface it is sprayed on. In FIG. 5, the closed cell spray foam 507 has been applied to the framing 505 and sheathing 504 so as to create an insulating barrier in the framing cavity 508.

Figure 6:
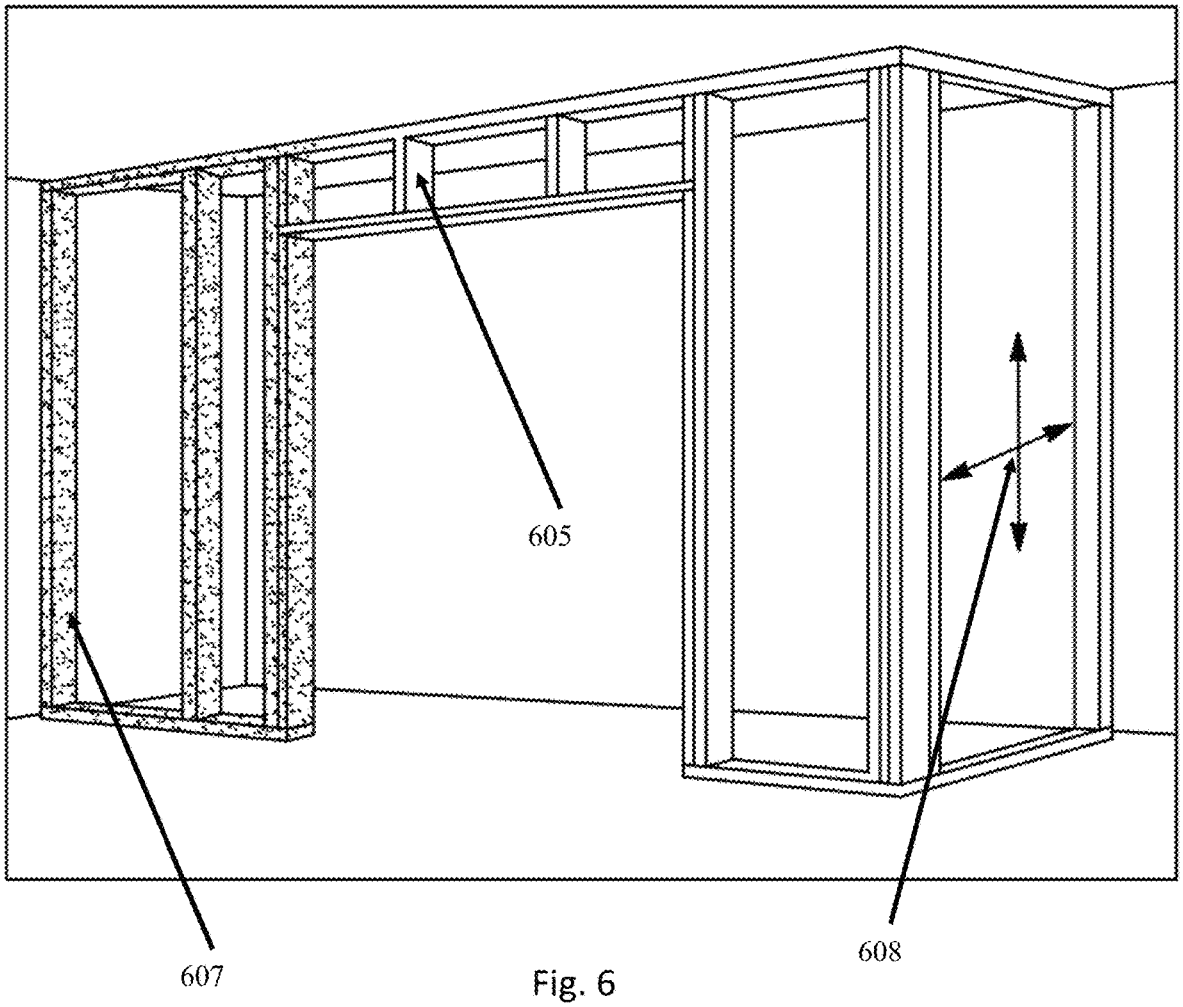
FIG. 6 depicts an embodiment wherein the interior portion of an interior wall of a building is utilizing closed cell spray foam insulation.

FIG. 6 depicts an embodiment wherein the interior portion of an interior wall of a building is utilizing closed cell spray foam 607. In this embodiment, the spray foam is covering some of the framing 605 as a form of reducing heat conductivity through the framing 605 and/or protecting the framing 605 from water exposure. In typical interior walls, the framing cavity 608 lacks a structure (e.g., sheathing) for the spray foam to adhere to. Where cavity insulation is desired, the spray foam can be successively applied on itself to become self-supporting between the studs. Alternatively, other physical structures (netting, plywood, additional framing, rigid foam, etc.) may be provided (permanently or temporarily) to supply a place or backing for the application of the spray foam. For example, cement board (or alternatively OSB or plywood or rigid foam, which may or may not be treated so as to be water-resistant) is placed in (or outside) the framing cavity providing one or two "sides" for the application of spray foam. The board thus acts in a fashion similar to sheathing for an exterior wall and is protected on at least one side from water exposure by the spray foam. Spray foam may be applied on one or both sides as may be desired.

Figure 8:
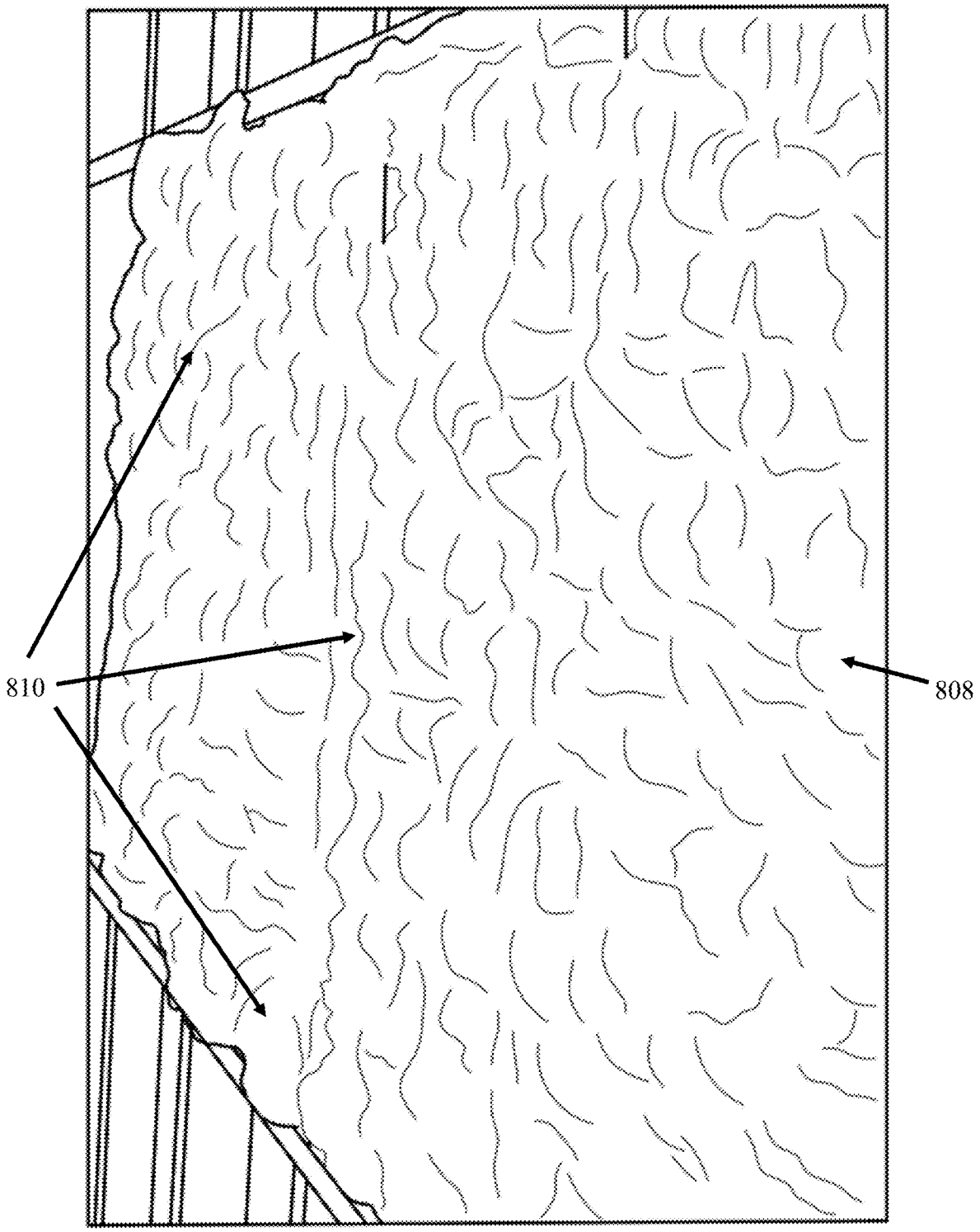
FIG. 8 depicts closed cell spray foam forming various shapes such as cavities and hills and trenches.

One issue with using closed cell spray foam is that it's shape when sprayed, in some types of applications, is not always consistent, rather, the spraying process sometimes forms the foam into various less desirable shapes and textures. An example of this is shown in FIG. 8 where spray foam 808 forms various shapes 810 such as cavities and hills and trenches. When exposed to flood waters, these some of these foam shapes 810 (as well as other types of shapes in the foam, but not all shapes) have the potential to harbor tiny pools of water or serve as a lodging place for dirt, sand, and/or organic debris. These less-desirable shapes may be (but need not be) re-shaped (e.g., flattened or smoothed over) after the spraying process before the foam is fully cured, or even after full curing.

Figure 9:
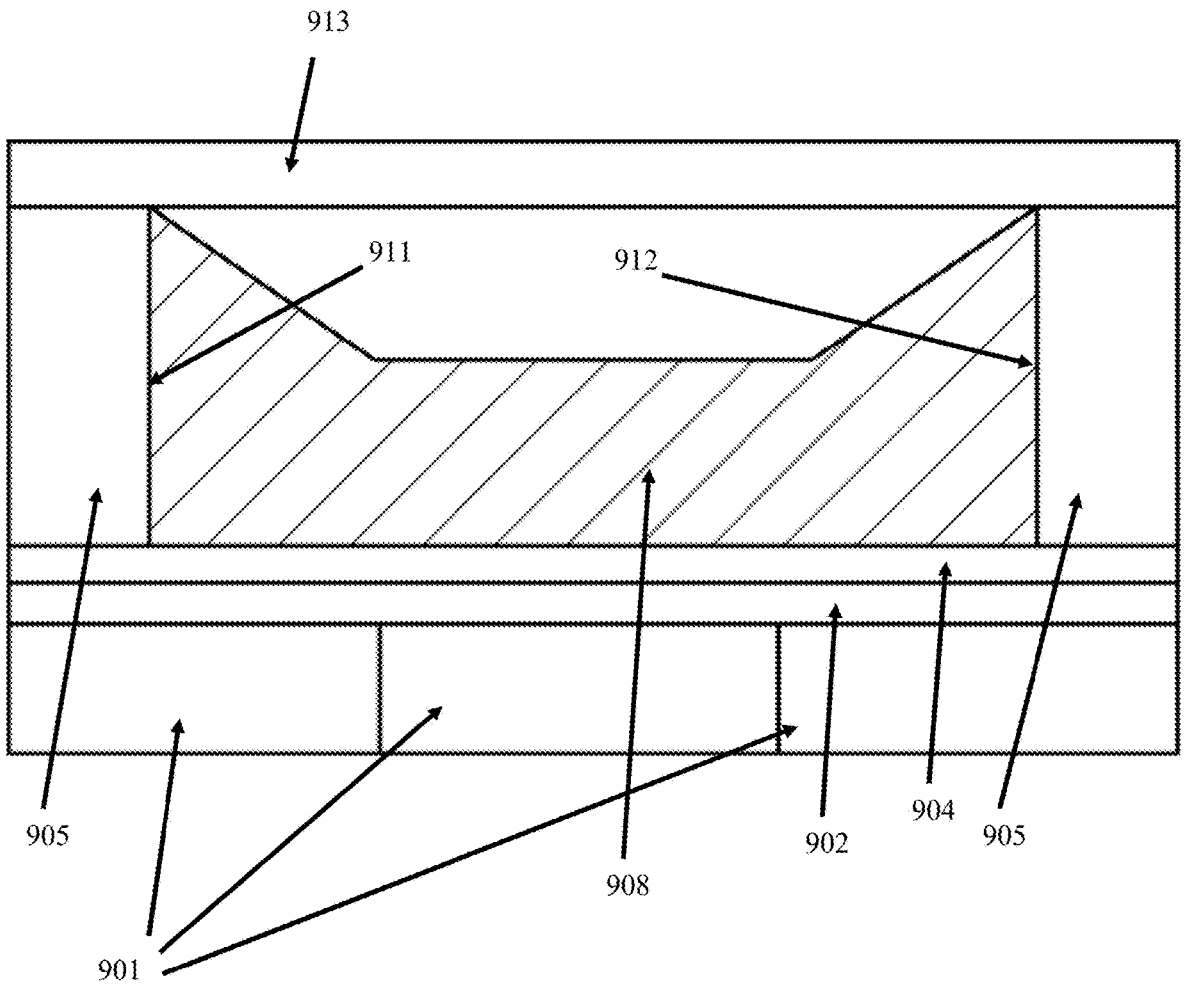
FIG. 9 depicts an embodiment via a top-down view of an exterior facing wall segment.

Post-spraying shaping can be done, for example, by cutting with a knife, wire, hot wire, saw, or sharp object. Other options include compression molding with a shaped form or jig, or smoothing/flattening with a tool such as a spade, trowel, or a piece of wood such as a paint stirring stick. Foam may also be sprayed into jigs or forms that guide the shape of the foam during actual spraying. In one preferred embodiment, the spray foam is a medium to high density polyurethane spray foam. Low-density spray foam may also be used in some applications also.

Where shaping is desired, one shape that may be used for the spray foam to form ruts in a _/ or |_| shape. This is illustrated in FIG. 9 which depicts an approximation of a top-down view of an exterior facing wall segment. FIG. 9 has a brick exterior 901, a water-resistant barrier 902, sheathing 904, framing 905, internal wall material such as drywall or cement board 913, and spray foam 908. The spray foam forms a rut in approximately a _/ shape between the framing studs. The ruts may extend the full vertical length of the interior of the framing cavity. In some situations, the ruts need only vertically extend from the base plate to, or a few inches above, the high-level water mark or the anticipated high-level water mark. For example, if the highest anticipated water level is one/two/four/six feet above a cement floor foundation, then the ruts may begin at one/two/four/six feet (respectively) above a base plate on the cement foundation and extends downwards. The base plate provides, for example with a nominal 2×4 stud, an additional 1.5" of water clearance, if additional measure of safety clearance is desired, then the ruts may start that much higher.

Ruts may be of varying widths or depths. In some framing cavities, the width between two vertical framing studs is 14.5 inches, in other embodiments the width may be narrower or larger. Generally speaking, the width and depth of the rut trades off with the effectiveness of the insulation. For example, deeper and wider ruts generally reduce the amount of spray foam present for insulation purposes. In some situations, this is not an issue, as even a minimal amount of spray foam (or even none in view of other insulation or if there is no desire for insulation) is sufficient for the building.

Where maximal insulation is desired, the ruts may be shallower and narrower. In some embodiments, the depth of the rut is limited by the dimensions of the vertical framing in conjunction with the sheathing. Where a 2×4 is used as a vertical framing stud, the true size will be approximately 1.5×3.5 inches, yielding an approximate maximum depth of 3.5 inches. The following Table 1 below presents various widths and depths and corresponding length options for vertical ruts, as averaged from the vertical top to the vertical bottom of the rut, measuring the rut width from the portion closest to the wall material and the depth from the front plane of the framing cavity (e.g., where the wall material is mounted) to the back plane of the framing cavity (e.g., where the sheathing is present) as defined by the vertical framing. These are not meant to be exhaustive but merely representative of various embodiments.

TABLE 1

| Example # | Width (inches) | Depth (inches) | Possible Length(s) |
|---|---|---|---|
| 1 (corner spray) | 13.5 | 3.25 | Full framing cavity |
| 2 | 13 | 3.25 | 9' |
| 3 | 13 | 3 | 8' |
| 4 | 13 | 2.5 | 7' |
| 5 | 13 | 2 | 6' |
| 6 | 12.5 | 2.5 | 5' |
| 7 | 12 | 3 | 4' |
| 8 | 12 | 2.5 | 3' |
| 9 | 10 | 3 | 2' |
| 10 | 10 | 2.5 | 1' |
| 11 | 8 | 3 | 10' |
| 12 | 8 | 2.5 | 8' |
| 13 | 8 | 2 | 6' |
| 14 | 8 | 1.5 | 4' |
| 15 | 8 | 1 | |
| 16 | 7 | 3 | |
| 17 | 6 | 2.5 | |
| 18 | 6 | 2 | |
| 19 | 5 | 1.5 | |
| 20 | 4 | 2 | |
| 21 | 2 | 1.5 | |
| 22 | 2 | 0.5 | |
| 23 | 13 to 2 | 3.25 to 0.5 | 4" - Full framing cavity |
| 24 | 12 to 2 | 3 to 0.5 | 4" - Full framing cavity |
| 25 | 12 to 4 | 3 to 0.5 | 4" - Full framing cavity |
| 26 | 10 to 2 | 2.5 to 0.5 | 4" - Full framing cavity |
| 27 | 9 to 2 | 3 to 0.5 | 4" - Full framing cavity |

Figure 7:
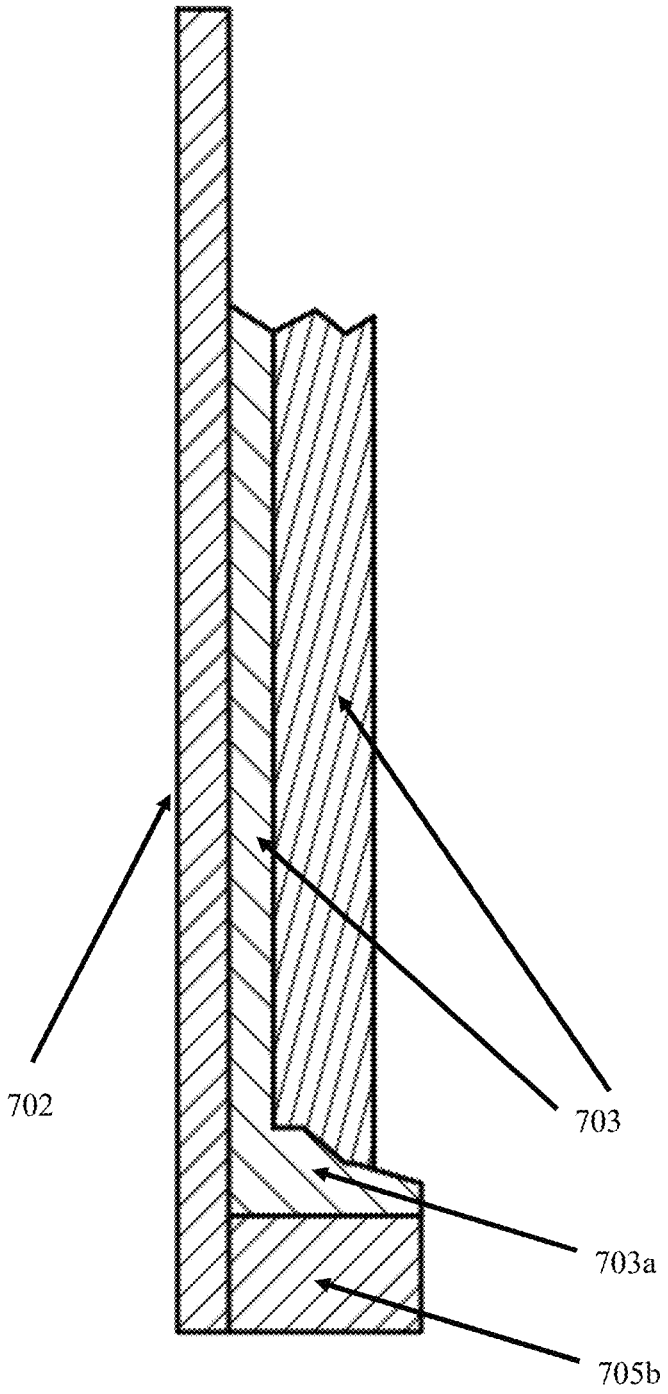
FIG. 7 depicts an embodiment using a spray foam rut and ramp.

At the base of the channel, the vertical rut may terminate at the base plate, or, as shown in FIG. 7, spray foam 703 may be applied to form a downward sloping ramp 703*a* at the base of the channel near the base plate 705*b* and against the sheathing 702 (to guide blown air upwards into the air cavity as discussed later herein). The vertical rut may also terminate several inches above the bottom of the framing cavity, with spray foam filling the lower portion of the framing cavity. In some cases, a vertical rut may not be present but the spray foam may still form a ramp at the baseplate. In one embodiment, the vertical rut begins at least one foot above the base plate and extends downwards at least 10 inches towards the base plate. In another embodiment where a base plate is not present, the vertical rut begins at least one foot above the foundation and extends downwards at least 10 inches towards the foundation. In another embodiment, the vertical rut begins above the high-water line from a prior flooding event and extends downwards at least 6 inches. The specific application depends on various circumstances such as insulation preferences or requirements, as well as drying preferences in view of the mounting of the wall coverings as discussed later.

An arc, semi-circle, oval, or crescent shaped rut can also be used. In some embodiments, (with reference to FIG. 9) the interior facing portion of the framing studs 905 are generally kept clean of spray foam to facilitate the attachment of the internal wall material 913 (e.g., water-resistant drywall or cement board). Spray foam on the interior facing edges of the studs may lead to bending or distortion of the flat surfaces of the walls. Often times this issue can be ignored or easily remedied by cleaning the studs by cutting or brushing off spray foam during installation of the wall materials.

There are some particular advantages of forming the spray material in ruts in an approximate/shape. One potential advantage is that the ruts, from a vertical perspective, minimally resist the downward flow of water and debris. Another potential advantage is that the ruts covers the interior sides 911, 912 of the framing 905, protecting a large surface area from water exposure. The spray foam also largely seals the sheathing 904/framing 905 corner interface. Other potential advantages are discussed later herein.

Figure 10:
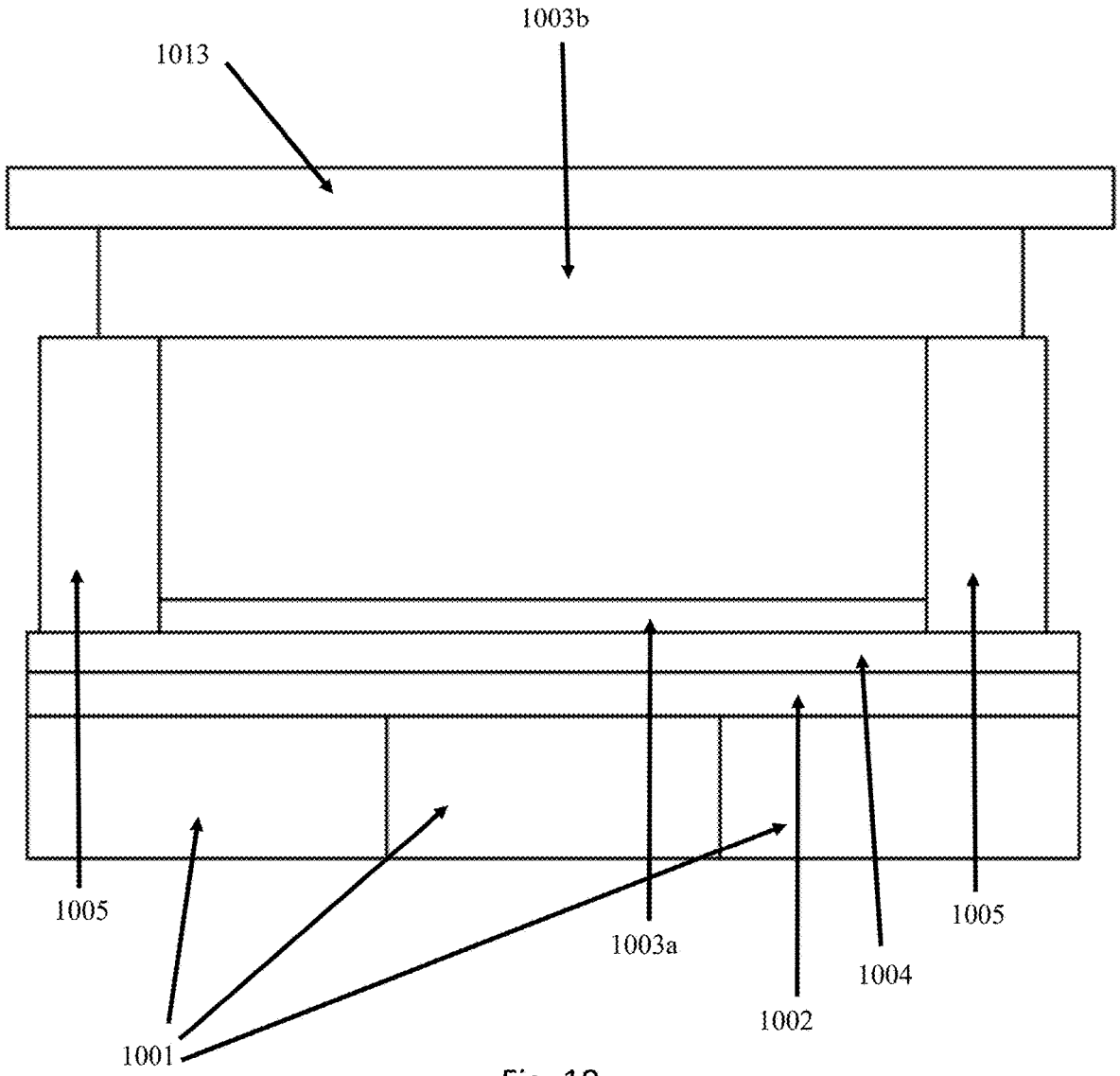
FIG. 10 depicts a top-down view of another embodiment where instead of spray foam, rigid closed cell foam sheets are used.

There are some disadvantages to using spray foam, one of which is that spray foam, and the labor for installation, may represent an excessive cost, or not be prudent or desirable in light of climate or construction preferences. FIG. 10 depicts a top-down view of another embodiment where instead of spray foam, rigid closed cell foam sheets are used. FIG. 10 has a brick exterior 1001, a water-resistant barrier 1002, sheathing 1004, framing 1005, internal wall material such as drywall or cement board 1013, and spray foam 908. The foam sheets 1003*a* & 1003*a* may be placed between the studs (1003A), or between the studs interior facing edge and the wall material (e.g., drywall or cement board) as shown by foam sheet 1003B, or both. One advantage to using rigid foam sheets is that some types are very resistant to water exposure and dry quickly. They are also easy to install and may be reused after exposure to water. If screws, nails, bolts, and/or other fasteners or attachments are used in attaching the foam sheets 1003A & 1003B, then any holes made may, if desired, be caulked or sealed using caulking such as waterproof silicone caulk. They may also be re-caulked after demolition and reinstallation. Waterproof or water resistant (e.g., from chemical or metal coatings) screws, nails, bolts, and/or other fasteners or attachments are preferred for locations where exposure to water is likely so as to help minimize rusting, discoloration, and/or color bleeding.

One aspect of foam sheets is that they may need to be removed so as to more rapidly and completely dry out and remove debris from the area between the foam sheet 1003A and the sheathing 1004. Also, the area between the foam sheeting 1003B and the wall material 1013 and also the area between the framing 1005 and the foam sheeting 1003A or 1003B may trap water and/or debris. Some potential (but not required) ways to address those issues is to mount the foam board with removable attachments (e.g., screws), mounting blocks or plates or brackets, or to use nails (e.g., finishing nails) that remain in the framing but have limited resistance to the removal of the foam sheets. For example, finishing nails easily pierce the foam but offer little resistance to pulling away, allowing for removal by pulling the foam away from the finishing nails which remain in the wood, and re-installation by pressing the foam back into place using either the same holes or new holes that the tops of the finishing nails create. Friction fit or tension fit of the foam sheets may also be available for some applications. By facilitating removal and reinstallation, the costs and/or time associated with reconstruction can be reduced.

Additionally, both rigid cell foam and closed cell foam may be used simultaneously. For example, the spray foam may be used as shown in FIG. 9 in conjunction with rigid foam sheets as shown in FIG. 10. Where rigid foam is placed between the framing, spray foam may (but need not be) applied on top of the rigid foam to seal in (or partially seal in) the rigid foam between the sheathing and spray foam (in some cases this may reduce the volume of spray foam needed). In some circumstances, the spray foam may be applied to the studs and/or sheathing and the rigid foam may be pressed into or onto the spray foam while drying. Or in some cases the rigid foam may simply be added between the studs as another layer between the spray foam and the wall materials. Where rigid foam is placed in a location between the studs and the wall materials as in 1003B, the spray foam and the rigid foam between the studs may also complement each other's insulating properties.

One of the major costs of flood remediation in terms of time and expense and disposal is compromised drywall. Drywall is typically made of paper products and gypsum. While some forms of drywall are partially water-resistant, many flood scenarios will compromise its integrity. When prolonged water exposure or immersion is likely, cement board may be a viable replacement for drywall. Cement board (sometimes called cement backerboard) typically comprises cement and reinforcing fibers. Sometimes polystyrene foam beads or wood particles are used instead of fibers. Cement board is typically used in applications where exposure to water is expected, such as in bathrooms and kitchens.

Many types of cement board such can be exposed to water for relatively long periods of time (as compared to drywall) without significantly adversely affecting the material. Cement board has not heretofore been considered as an appropriate wall material for bedrooms, living areas, or office areas. This is due to many factors, including its weight and cost. Cement board is also difficult and time consuming to cut as compared to drywall.

Yet when textured and painted, drywall and cement board are very difficult to distinguish. Both drywall and cement board cooperate well with screws and nails and pins that may be used in connection with wall décor or accessories. And cement board has some significant advantages in flood-prone environments.

While cement board is more difficult to install than drywall, it's resilient nature lends itself to re-use post-flooding. While some cement board is water-proof or very water resistant when manufactured, cement board may also be treated with a waterproof spray or sealant prior to installation. Anti-fungal or mold treatments may also be applied if desired.

Figure 11:
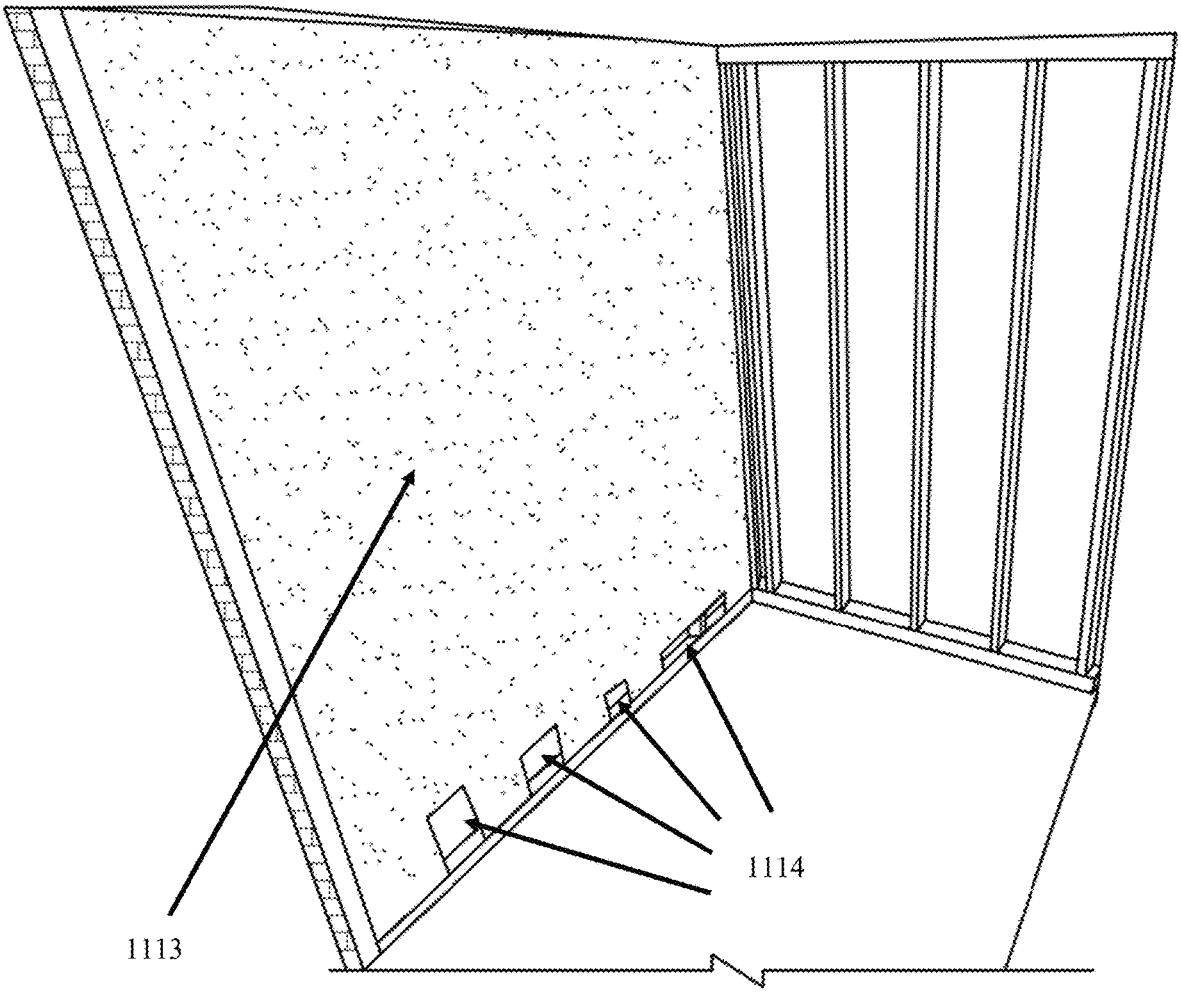
FIG. 11 depicts an exterior wall embodiment where cement board with weepholes is used to replace drywall as a wall material.

FIG. 11 shows an exterior wall embodiment where cement board 1113 is used to completely replace drywall as a wall material. The cement board 1113 is approximately flush with the ceiling. The cement board 1113 is not (yet) textured or painted. The cement boards near the floor have weep holes 1114 that may align with, or may partially overlap, the cavities between the vertical framing studs. These weep holes 1114 (shown in various sizes) may, in some embodiments, align with ruts in spray foam (not shown) behind the cement board.

The weep holes allow for water and debris to drain out of the wall cavities (or in some embodiments, down the ruts) and out the weep holes 1114 onto the floor as flood waters recede. It also allows for air to be blown towards the weep holes 1114 and facilitate channeling that air up the framing cavity behind the cement board so as to facilitate the drying of the material behind the cement board. Depending on the framing, the blown air may also travel up into the ceiling above the wall and then down into another cavity and exit a different weep hole 1114. Additional gaps or holes may also be present to facilitate air movement when drying. These gaps or holes are also helpful in reducing the internal water pressure that builds up in framing cavities against the cement board when flood waters rise by allowing water to flow under them instead.

There are various properties associated with weephole widths. Wider and/or more frequent weepholes offer more volume of air and/or water to pass through them. By spanning two or more studs, wider weepholes may allow for better air circulation from a single blower and may allow for better cross-framing cavity airflow. Narrower and/or less frequent weepholes offer additional structural support in the cement board at the floor level for the physical attachment of baseboards. They also provide lateral support so that, for example, shoe molding on the baseboard may more easily be affixed at the floor-level without bending the baseboard inwards towards the studs. Weepholes may also have standardized sizes (e.g., 4×6 inches for rectangular shaped weepholes), so as to allow a wall adapter (as discussed later) to fit one or more of them.

In some embodiments the weep holes 1114 approximately align with, or at least partially overlap, vertical ruts in spray foam behind the cement board 1113. In some embodiments the weep holes 1114 may be randomly placed, so that some weeps holes 1114 at least partially overlap vertical ruts in the spray foam, while some do not. In other embodiments, the weep holes 1114 may be large and overlap two or more vertical ruts or framing cavities. The weepholes may also extend higher, lower, or equal in height to the expected (or prior) high-water mark of a flooding event. When rigid foam sheets are used, the rigid foam sheets may also have cutouts that correspond to the cement board's weep holes 1114. In some embodiments, the rigid foam sheets may also be cut so that the lowest portion of the rigid foam is flush with the top of the weep holes 1114.

Figure 12:
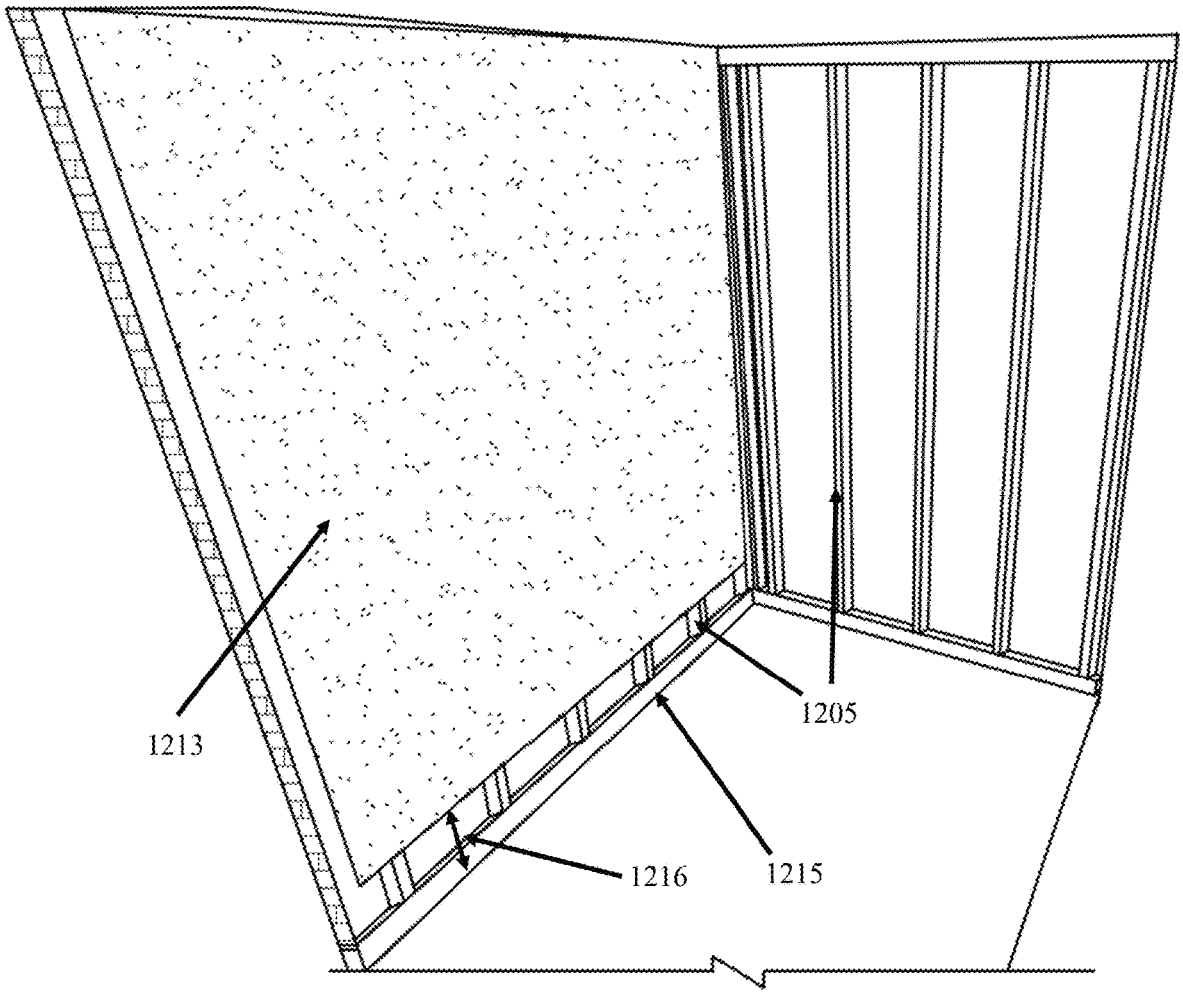
FIG. 12 depicts an exterior wall embodiment that utilizes cement board in conjunction with an air gap.

FIG. 12 depicts another exterior wall embodiment that utilizes cement board 1213. Whereas the cement board in FIG. 11 had weepholes along the bottom, the cement board 1213 in FIG. 12 is mounted directly to the framing studs above the bottom stud 1215 of the framing 1205 forming a gap 1216 between the cement board and the base plate along the full width of the bottom of one or more framing cavities (or along the entire length of the cement board). This gap 1216 may perform a similar function as the weep holes. The gap 1216 may allow for the flow of water and debris from behind the wall. The gap 1216 may also allow for the entry and exit of blown air into the framing cavities behind the cement board 1213.

When spray foam is used for insulating the wall, vertical ruts in the spray foam may, but need not, be present. When rigid foam sheets are used for insulating the wall, a rigid foam sheet may also be arranged so as to be flush with the bottom of the cement board 1213 and the top of the air gap 1216. Alternatively, the rigid foam sheet may also be arranged so that its lower edge is slightly above the bottom of the cement board 1213 so as to not intrude into the air gap 1216. In some embodiments, the rigid foam sheet may protrude (in some cases not more than ⅜") below the cement board 1213 and into the air gap 1216. The latter case is particularly useful where if the cement board may be removed leaving the rigid foam sheet in place during the remediation process. The air gap may also extend to a point above the top of the base plate that is higher, lower, or equal in height to the expected (or prior) high-water mark of a flooding event.

If a bottom stud 1215 (also called a base plate) was not present, the gap 1216 between the floor and the cement board could be smaller relative to the distance above the floor. In some embodiments, the gap 1216 between the foundation (in the case of a cement foundation) and the bottom of the cement board 1213 can be 4". One common size for a bottom framing stud 1215 is a nominally sized 2×4's with actual dimensions of approximately 1.5"×3.5". In such a case the air gap 1216 as measured between the top of the bottom framing stud 1215 and the bottom of the cement board 1213 may be approximately 2.5". The air gap 1216 may be between 0.5" and 18". There are various advantages to each air gap 1216 size. The following Table 2 discusses some of the properties of certain air gap 1216 ranges. These ranges are also generally appliable to weep hole air gap heights.

TABLE 2

| Air Gap | Some Typical Properties |
|---|---|
| 0.5"-1" | Compatible with 3" baseboards with a single bottom stud having a nominal size of 2 × 4.<br>Compatible with 3"+ baseboards with no bottom stud. |
| 1"-1.5" | Some intermediate gaps are compatible with 3"-3.5" baseboards with a single bottom stud having a nominal size of 2 × 4.<br>Compatible with 3.5"+ baseboards with a single bottom stud having a nominal size of 2 × 4.<br>Compatible with 3"+ baseboards with no bottom stud. |
| 1.5"-2" | Some intermediate gaps are compatible with 3.5"+ base-boards<br>with a single bottom stud having a nominal size of 2 × 4.<br>Compatible with 4"+ baseboards with a single bottom stud having a nominal size of 2 × 4.<br>Compatible with 3"+ baseboards with no bottom stud. |
| 2"-2.5" | Some intermediate gaps are compatible with 4" + base-boards<br>with a single bottom stud having a nominal size of 2 × 4.<br>Compatible with 5"+ baseboards with a single bottom stud having a nominal size of 2 × 4.<br>Compatible with 3"+ baseboards with no bottom stud. |
| 2.5"-3" | Each gap size increase typically requires taller and taller base boards. |
| 3.5"-4" | Taller baseboards may require fastening to vertical studs as |
| 4"-4.5" | even when a base plate is present. |
| 4.5"-5" | Larger sizes increase the cost of materials but allows for increased airflow. |
| 5"-6" | Paneling may be more cost effective or may be more visu-ally |
| 6"-8" | attractive. |
| 10"-12" | Air gaps may start overlapping electrical outlets. |
| 12"-14" | Paneling may be more cost effective or may be more visu-ally |
| 14"-18" | attractive. |

The height of the air gap 1216 may vary along the wall due, among other reasons, to the straightness or squareness (or lack thereof) in the wall, ceiling, or adjoining walls. Likewise, the straightness of the edge of the cement board (and the squareness and/or straightness of its mounting) may also affect the height at different points along its length. As such, the air gap in these examples is measured from the lowest edge of the cement board to the top of the base plate below that lowest edge. When no base plate is present, the air gap is measured from the lowest edge of the base plate to the top of the floor/foundation existent directly below the lowest edge when the cement board is installed. Finished flooring may necessitate a larger air gap in some circumstances. The air gap may also be measured (in conjunction with or in place of the prior method) by the average distance from the bottom edge of the cement board to the top of the base plate (if present, else the floor/foundation existent directly below the bottom edge when the cement board is installed) along the length of the bottom edge of the cement board.

With respect to baseboards, they may be treated with a waterproof coating or sealant before being installed onto the wall. Plastic or other water-proof materials may not need treating. Finishing nails can also be treated with a water-proof coating before being used to secure the baseboards in place and avoid rusting and discoloration and color bleeding.

Figure 13:
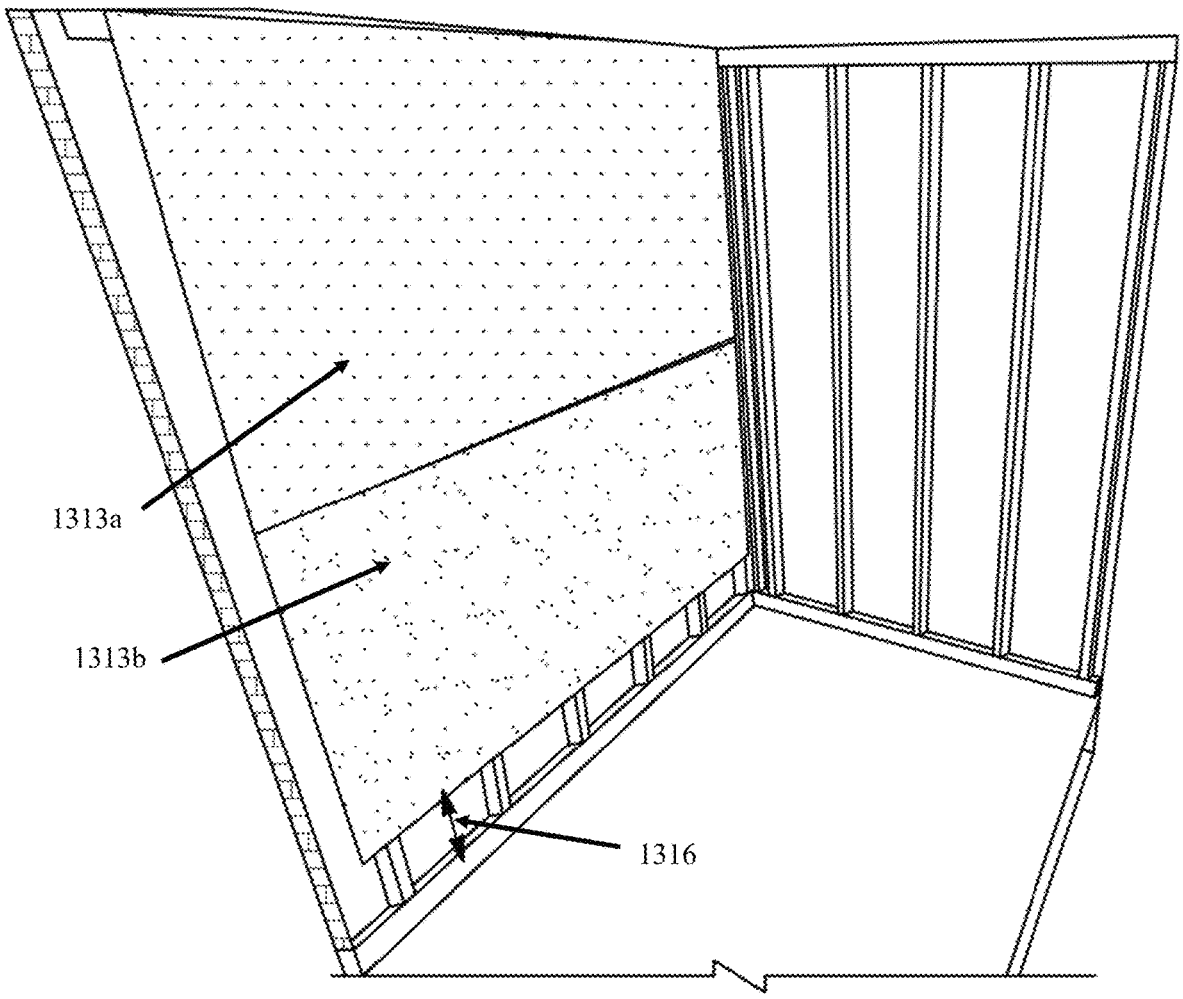
FIG. 13 depicts an exterior wall embodiment where drywall is used in an upper portion of the wall and cement board is used in a lower portion of the wall.

FIG. 13 shows an alternative exterior wall embodiment where drywall 1313*a* is used in an upper portion of the wall and cement board 1313*b* is used in a lower portion of the wall. In some flood-prone areas, the water levels are only expected to rise a foot or two above the flooring. In such situations, the drywall that is about 1 to 2 feet above the high-water level may not be compromised and/or may not necessarily need to be replaced. This leads to situations where a lower portion of the wall (in some smaller use cases the strip has a height of 1"-2" or 2"-3" or 3"-4") may be cement board while an upper portion of the wall may be drywall. Such a situation may lead to significant cost savings if higher water levels are believed to be unlikely. FIG. 13 shows an air gap 1316 as in FIG. 12, but weep holes as in FIG. 11 are also an option.

Coverings such as baseboards (for example with lower air gaps) or paneling (for example with relatively higher air gaps if large baseboards are not desired) may be used to cover the air gap 1817. The cement board 1813 may have rigid and/or spray foam attached to or incorporated into it as with other embodiments. In some circumstances, such as when the water levels did not rise above the cement board, or did not rise above the air gap 1817, the cement board may be left in place. It may also be removed and/or reinstalled as part of the post-flood remediation process.

Figure 14:
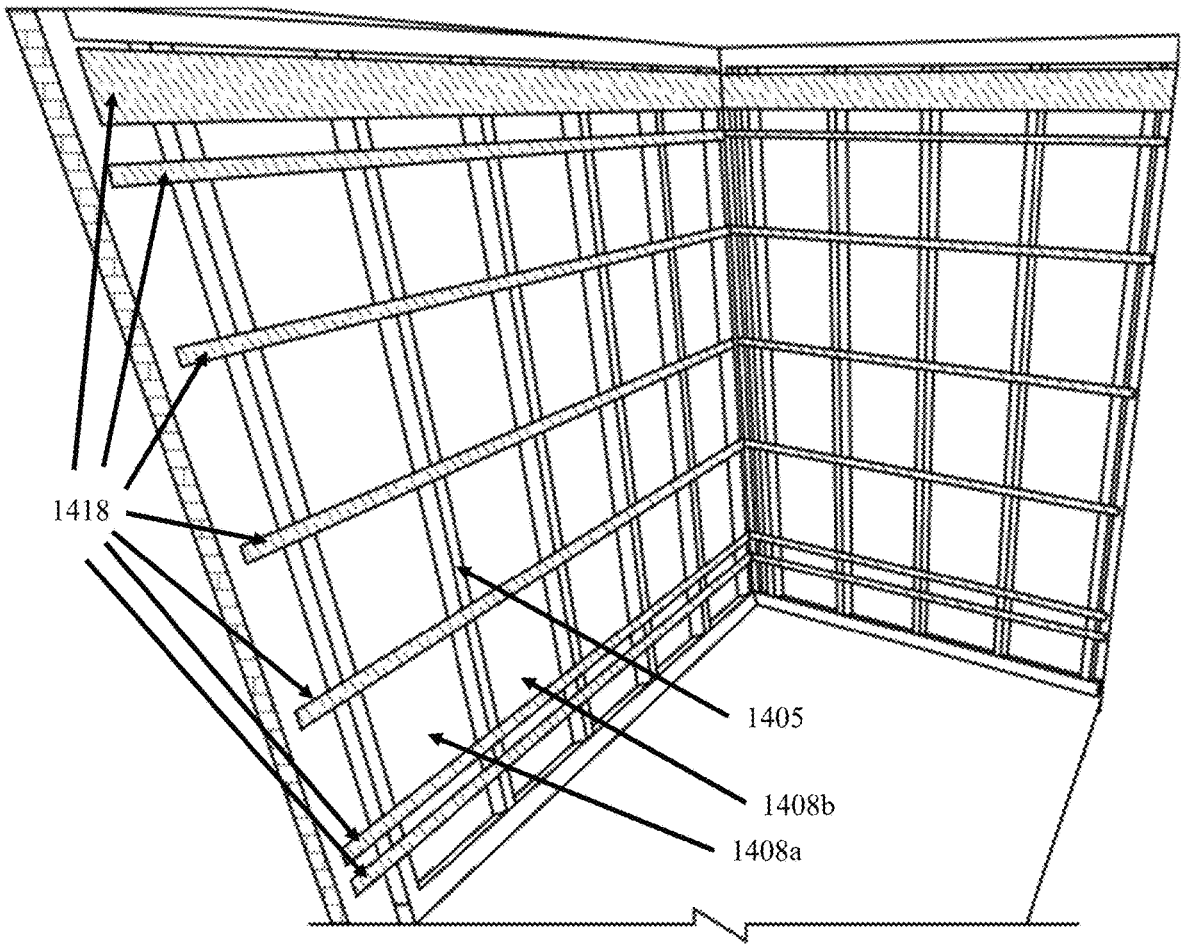
FIG. 14 depicts an alternative exterior wall embodiment where furring strips are laid horizontally across the framing to create a gap between the wall materials and the framing studs.

FIG. 14 shows an alternative exterior wall embodiment where furring strips 1418 (also called furring board or wood strapping, but other non-wood based materials like metal or plastic furring strips may be used) are laid horizontally across the framing 1405. The cement board (not shown) may be mounted onto these furring strips 1418, or mounted directly to the framing 1405 through the furring strips, or mounted directly to the framing 1405 without the fasteners passing through the furring strips, or some combination thereof. These furring strips 1418 may (but need not) receive water and/or insect treatments. Generally, the furring strips provide a small gap between the cement board and the framing 1405. This permits air blown through the air gaps (or weep holes) to more easily transverse the adjacent framing cavities 1408*a* and 1408*b*.

Figure 15:
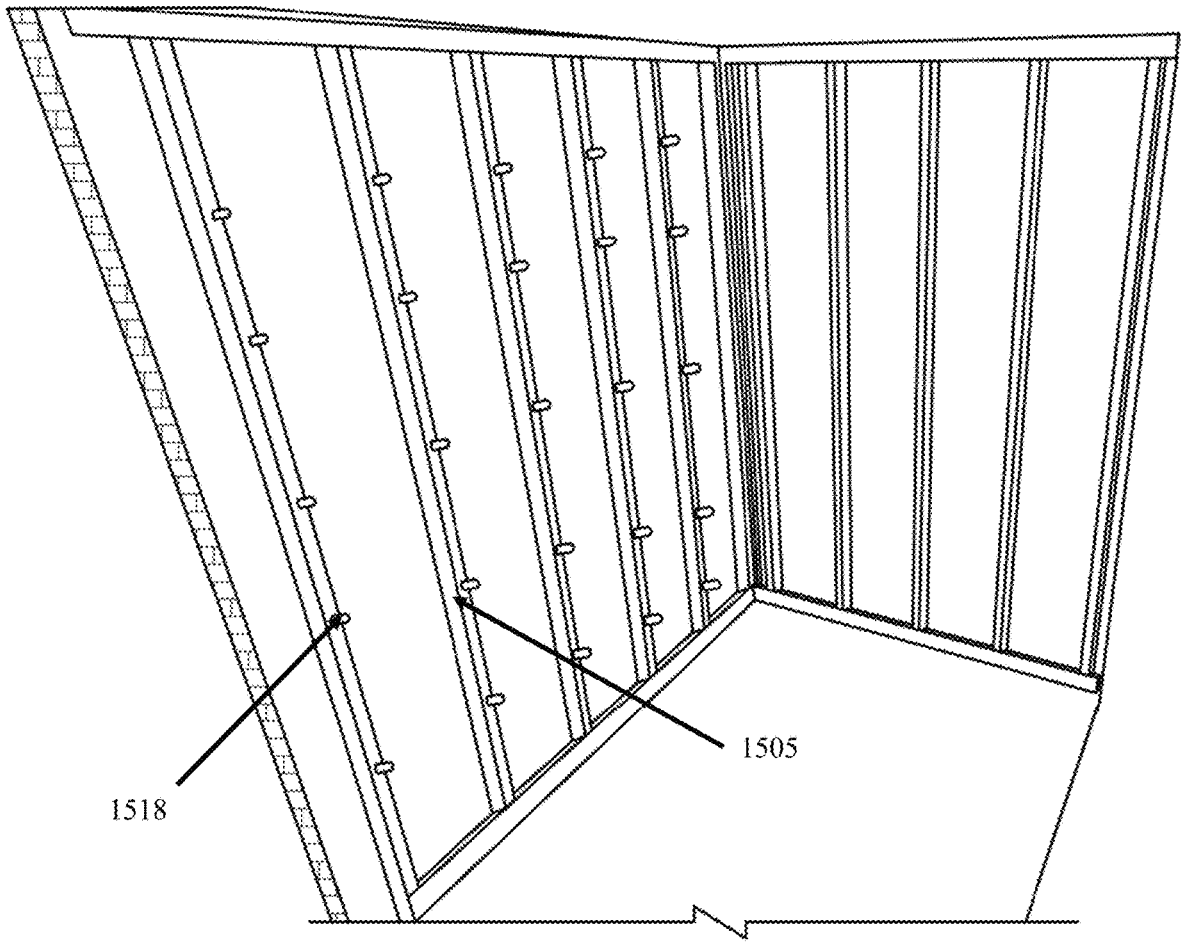
FIG. 15 depicts an alternative exterior wall embodiment where instead of furring strips, mounting blocks are used to create a gap between the wall materials and the framing studs.

FIG. 15 shows an alternative exterior wall embodiment where instead of furring strips, mounting blocks 1518 are used. The blocks can be wood, plastic, or metal, and may project from the framing 1505 from ⅛" to 3". A projection of about ¼" to 1" is generally sufficient, with ½" and ¾" each being a preferred embodiment. In some embodiments, a mounting block with a width between ¼" and 1", inclusive, may be used. But circumstances may warrant a smaller or larger offset. Also, the offset may vary along the vertical length of the framing 1505, depending on the straightness or squareness of the framing or adjoining walls or the ceiling. Mounting blocks 1518 typically provide less restriction overall to air movement than furring strips. Mounting blocks 1518 typically have less contact surface area with the cement board than furring strips, which may help reduce the potential for water pooling and for debris to lodge. Mounting blocks likely to be exposed to water are preferably water-proof or treated to be water resistant. Mounting blocks may be generally cubic, cylindrical, cuboid, or rectangular cuboid in shape.

Figure 16:
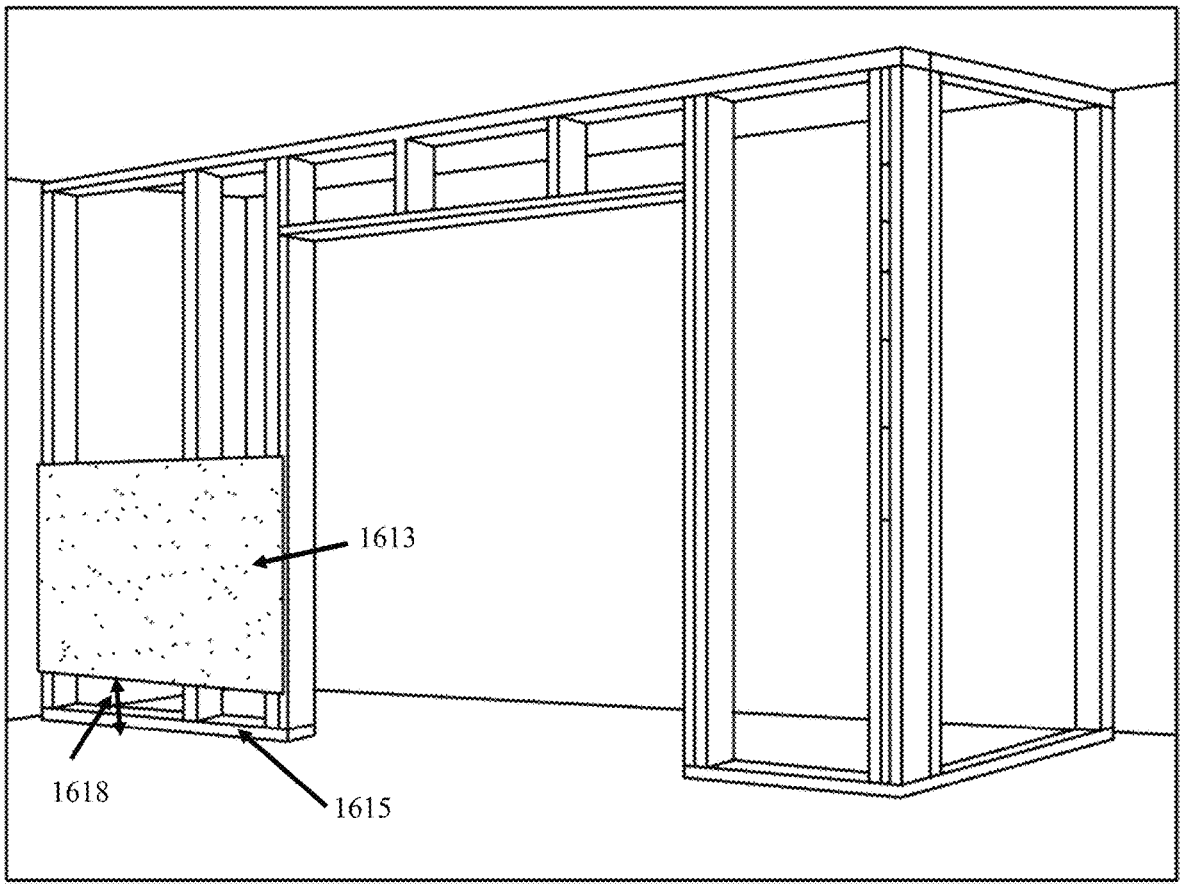
FIG. 16 depicts an interior wall embodiment using cement board mounted above a base plate to create an air gap.

FIG. 16 shows an interior wall embodiment. As discussed with respect to FIGS. 12-15, cement board 1613 is used along at least a lower portion of the interior wall, with an air gap 1618 created by raising the cement board 1613 above base stud 1615 (or if no base stud, the floor level). Weep-holes may be used instead of an air gap 1618. It will likely be the case that cement board should be used on both sides of an interior wall, as typically flood waters may affect the entire home. But in some circumstances, it may not be necessary due to things like hills, the levelness of the building's foundation, drainage, steps, and/or floor height differences.

There may be a difference between the air gaps 1618 on either side of an interior wall. In some embodiments, one side of the interior wall has an air gap but the other side does not. In other embodiments, the interior wall has air gaps on both sides of equal height. In other embodiments, the interior wall has air gaps of different heights. Differences in gap heights (as well as not having an air gap on one side) help divert air up through the framing cavity. But a difference in gap heights with respect to either side of the interior wall is not required.

Figure 17:
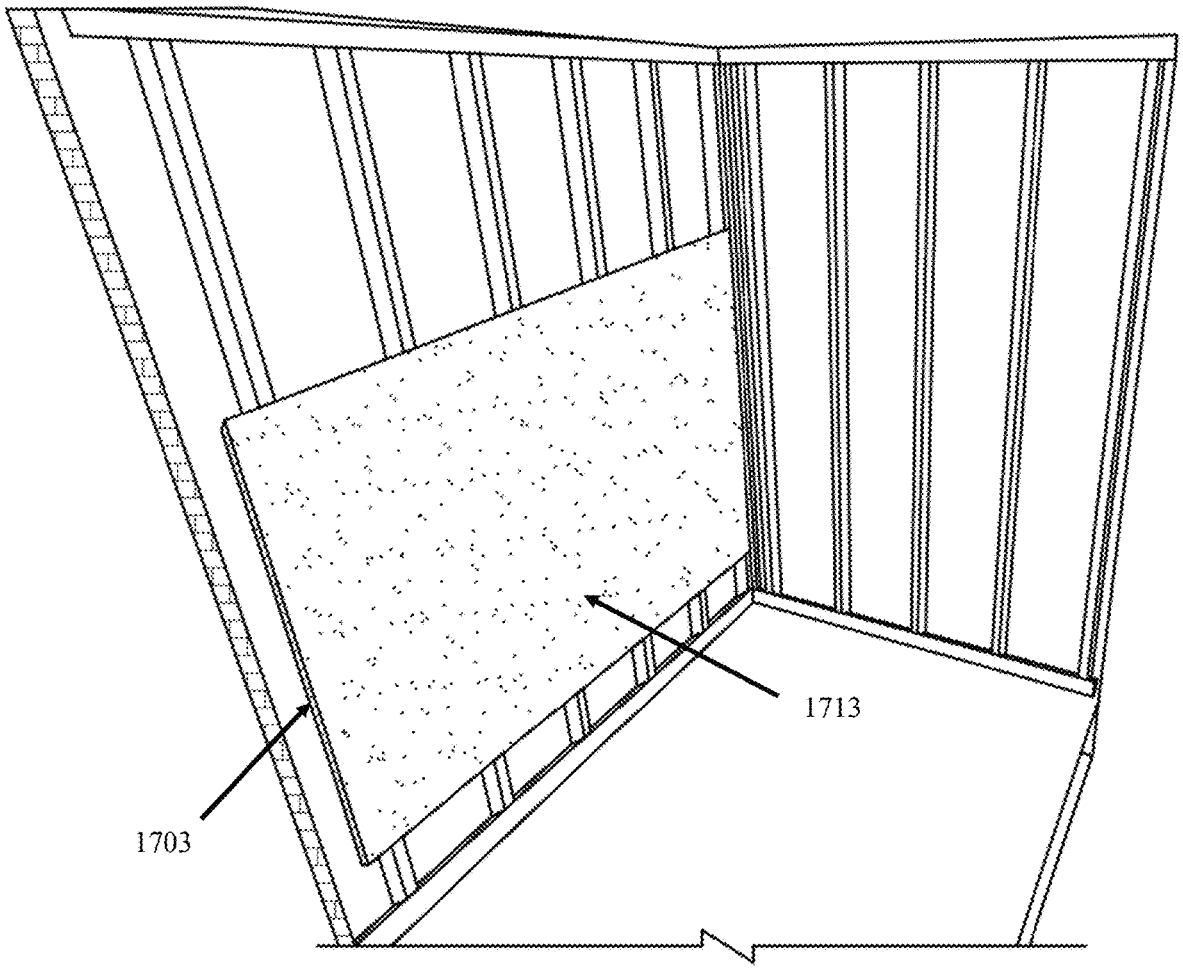
FIG. 17 depicts an exterior wall embodiment where rigid foam insulation has been sealed to the back of the cement board.

FIG. 17 depicts an alternative exterior wall embodiment without spray foam insulation. Instead, rigid foam insulation 1703 has been sealed to the back of the cement board 1713. The sealant used may be closed cell spray foam, silicone, polyurethane, neoprene rubber, or some other suitable water-proof or water-resistant sealer. In addition to, or in alternative to, sealer, the rigid foam insulation may be screwed, glued, or bolted to the cement board. Where holes are required due to the choice of attachment, the holes may be sealed over so as to be water-proof or water-resistant. Alternatively, the cement board and insulation may be formed together as an integral unit. This cement board/rigid foam insulation combination can be used in place of cement board as shown in the embodiments of FIGS. 11-17. It may be used separate from embodiments with spray foam, or together with embodiments with spray foam.

One potential advantage of the embodiment of FIG. 17 is that it, in some circumstances or in some climates, may (but need not), provide sufficient insulation in itself that spray foam is unnecessary. Where spray foam is not needed, the framing and sheathing and areas between the exterior brick or siding may dry faster after flood waters recede. The cement board/rigid foam combination may remain attached to the wall after a flood and dried in place with the assistance of the air gaps. The cement board/rigid foam combination may also be removed after a flood and dried independently from the remainder of the wall. Spray foam may be sprayed on or affixed on cement board (or on the back of the rigid foam, or between the rigid foam and the cement board) to provide a layer of insulation in addition to or in place of the rigid foam insulation.

The spray form and/or rigid foam may also be cut or shaped with vertical cut-outs, ruts, and/or channels so as to fit between the studs such that it does not force the cement board to protrude from the wall or so as to at least reduce some protrusion from the wall. The spray foam and/or rigid foam may also be cut or shaped with horizontal cut-outs, ruts, and/or channels so as to facilitate airflow between the framing cavities. In some circumstances, both horizontal and vertical cut-outs, ruts, and/or channels may be used.

In the embodiments discussed thus far, the cement board may be mounted to the framing or to furring strips or to mounting blocks, or a combination thereof. In each of these examples, the cement board is "mounted" to the framing (e.g., attached to something that is attached to the framing, or attached to the framing through something that is also in contact, directly or indirectly, with the framing), thus the term "mounting" is used in the common, general sense that does not preclude intermediary objects.

One advantage of cement board is that it tends to be more durable than drywall. One possible way to mount cement board to wood framing is to use screws. When care is taken, screws can be removed and reinstalled repeatedly using the same hole in the cement board. Other mounting methods like machine screws into a threaded plastic or metal mounting block also lends itself to easy removal and reinstallation.

In some post-flooding situations, for example where flood waters rose above the ceiling or where structural damage to exterior brick or siding occurred, it may be desirable to remove some or all of the cement board to facilitate reconstruction and/or whole house drying as rapidly as possible. In other post-flooding situations, for example when flood waters did not rise above the height of the lower mounted cement boards, removal of the cement boards may not be necessary as blowers may be more than sufficient to drive ample airflow behind the wall as facilitated by the weep holes or air gaps.

Typically, once the wall coverings (e.g., drywall, cement board) are installed, a few additional steps may be desired for aesthetic and/or insulation purposes. For example, tapping and floating/mudding may be used on the joints of drywall to give the walls the appearance of a single plane. Thinset and fiberglass may also be used in an analogous process to cover the joints in cement board. Many types of thinset have water resistant capabilities that lend themselves to situations where the cement boards may be left in place. In some circumstances, covering the joints may not be necessary, for example if aesthetics are not important or if wall paper or paneling is going to be used.

To enhance post-flood recovery, water resistant texturizing and paint may be used. Water resistant paints such as oils or acrylics may help reduce the amount of post-flooding remediation work on cement board exposed to water. Humidity resistant paints and texturing may also be used on drywall above the water that may be exposed to high levels of humidity during flooding. Where wallpaper is used, water resistant glues may also be used.

If baseboards, molding, paneling, and/or other types of gap or joint coverings are used, waterproofing and/or sealing treatments may be used therewith. This helps increase the possibility or recycling the materials post-flooding. Solid wood, engineered wood, plastic, or metal baseboards, molding, paneling, and/or other types of gap or joint coverings may also be used. These have the added benefit of being Waterproof and/or resistant paints may also be used.

Post-Flood Recovery

Post-flood recovery methods with respect to some of the embodiments of the present invention will now be discussed in greater detail. Recovery typically begins, as in other circumstances, with wet and damaged furniture and household goods being removed first, facilitating the removal and/or remediation of walls and flooring. When one or more structural embodiments of the present invention are used remediation of the wall may be faster and more cost effective than remediating a wall of a typical drywall and fiberglass insulation construction.

For example, when a cement board with weepholes as in FIG. 10 (or raised cement board with an air gap as in FIG. 11) is present, the cement board and any lower baseboards or paneling or molding may not need to be removed. During the course of receding flood waters, gaps occurring as a result of construction, in conjunction with weepholes or raised cement board with an air gap, may be sufficient to allow water and debris to exit the framing cavity and flow outside or on to the floor. In such cases, the wall and its baseboards or paneling or lower molding may remain intact during the drying process. This is because the absence of fiberglass insulation and gypsum drywall substantially reduces the need to destroy or deconstruct the wall in view of water damage and the potential for molding. The protective effects of spray foam and/or the protective effects of water-resistant treatments on materials in the framing cavity (e.g., sheathing, studs, etc.), likewise reduce the amount of airflow required, or in some cases the time required, to sufficiently dry the framing cavity. Also, the weepholes and/or air gaps associated with the cement board help facilitate water and debris flow even in the presence of obstructing its baseboards or paneling or lower molding.

In this and some other cases, all that may be required to dry the wall and its corresponding framing cavities is to provide and operate one or more dehumidifiers in the room with the wall. A building's air conditioning unit is essentially a built-in dehumidifier, which may also be sufficient in some cases to remediate water exposure without the need for a portable dehumidifier in the room. In other cases, the building's air conditioner and one or more portable dehumidifiers may be sufficient.

In some other cases, it may be expedient to remove some or all baseboard or paneling or other molding that may cover the weepholes (or air gaps). By doing so, the framing cavities may be exposed to substantially greater amounts of air circulation which may facilitate the drying operation of one or more provided portable dehumidifiers, which may be optionally working in conjunction with the building's air conditioner, or just the building's air conditioner may be used. The removed baseboards or paneling or other molding may be dried in the same or another room, or may be taken outdoors or elsewhere to dry.

Figure 18:
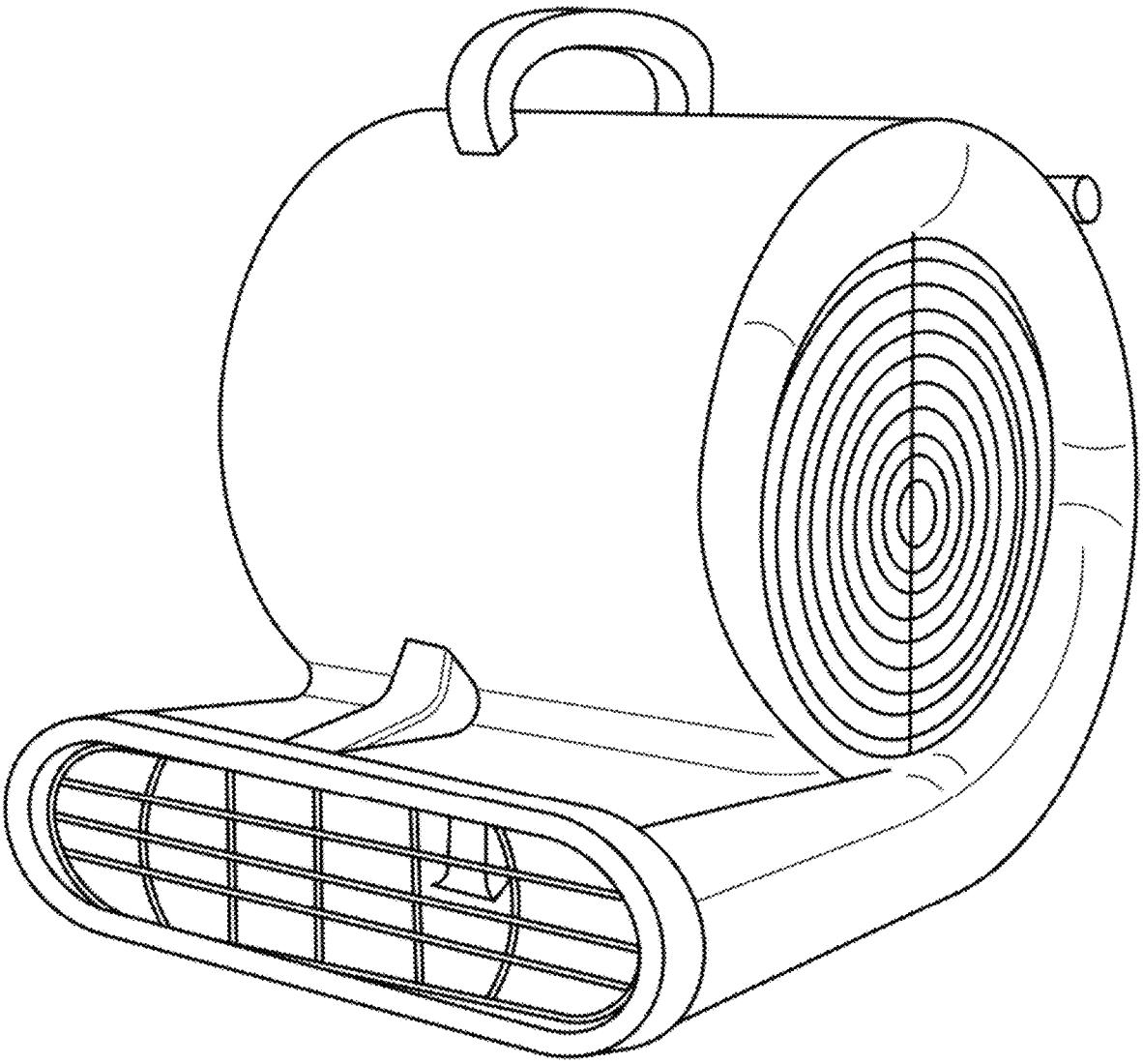
Fig. 18 Prior Art
FIG. 18 depicts a type of a portable fan blower.
Figure 19:
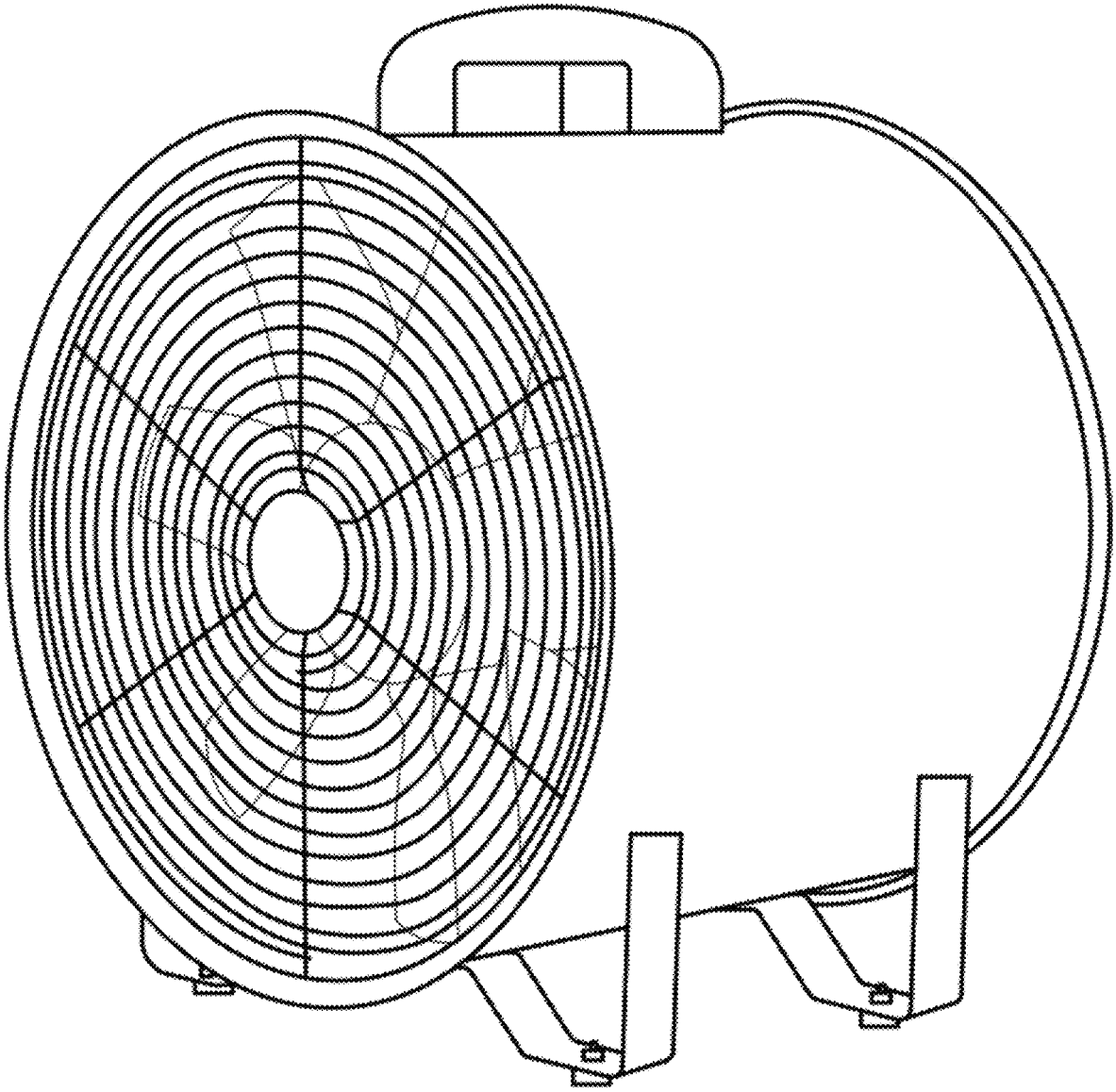
Fig. 19 Prior Art
FIG. 19 depicts another type of a portable fan blower.

In some other cases, one or more portable blower fans (including those of the types depicted in FIGS. 18 & 19, or other types) may be used to facilitate drying of the wall. By providing one or more portable blower fans and pointing the fan(s) at a weephole or airgap so as to blow air at or into the weephole or air gap, blown air may circulate within the framing cavity, drying the materials in the framing cavity. When furring strips as in FIG. 14 (or mounting blocks as in FIG. 16) are used, cross-framing cavity circulation tends to be enhanced and allows for more rapid drying of the materials behind the cement board. While removing the baseboard or paneling or other molding that may cover the weepholes (or air gaps) will typically facilitate drying through increased airflow, removal of some or all of the baseboards or paneling or other molding may not be necessary and the entire wall may be left intact in some circumstances.

In some cases, like when flood-water water levels were just a few inches high, directing airflow from a portable blower fan at a weephole or air gap may be sufficient even in the presence of obstructing baseboards or paneling or other molding due to small cracks, seams, gaps, and/or holes that permit sufficient airflow despite the obstruction. For example, baseboards that are mounted flush with a finished wood floor or a concrete foundation may still not be perfectly air-tight across the length of the wall, and/or may horizontally protrude slightly from the base plate or wall. Thus small construction "defects" may allow air to flow under or over the baseboard and into the framing cavity. Likewise, uncovered electrical outlets may provide sufficient gaps so that when providing a portable air blower and then blowing air at the outlet, air is able to circulate and dry nearby framing cavities.

Where a wall of a building has spray foam with vertical ruts, such as in FIG. 9, a vertical rut or channel allows flood water and debris to generally flow downwards within a framing cavity. When one or more portable blower fans are provided and pointed at a weephole or airgap so as to blow air at or into the weephole or air gap, the blown air tends to dislodge flood debris, allowing heavier particles to drop to the base plate or floor. Also, the vertical rut allows for air to circulate higher into the framing cavity, helping to increase the rate of drying and air circulation overall. In some embodiments (for example FIG. 7), the spray foam bordering the base plate forms a downward slanting ramp that, when blowing air is directed at a weephole or air gap, the ramp directs the blown air upwards into the framing cavity, increasing air circulation.

When drying is nearly complete, or even during the drying process, air may be briefly cycled (e.g., blown for 3 to 10 seconds and then halted) into the framing cavity allowing debris to be dislodged from the materials behind the wall and then settle down to the ramp or the base plate or the floor for cleanup. In such circumstances, a rut and/or a bottom spray foam ramp may facilitate that process, but are not necessary.

Essentially the same principles may be applied to interior walls. But since interior walls typically have two sides, removal of the baseboards or lower paneling or molding, if required, may in some cases only need to happen on one side (although both sides may be removed if it seems appropriate). Opening only one side may allow sufficient airflow to dry the framing cavity, thereby reducing the reconstruction efforts.

The prior discussed remediation methods primarily concern circumstances where the cement board(s) on a wall remains attached to the framing stud(s). In some cases, removal of a cement board may be warranted, particularly if water levels were higher than anticipated or if the air gaps or weepholes are felt to be not sufficiently large to allow adequate airflow to dry in a timely fashion. In such a case, the remediation steps may involve removing the baseboards or paneling or other lower molding. The cement boards may then be removed. In some circumstances, for example in FIG. 13, a cement board being removed may only comprise a lower portion of the wall, and the drywall above the cement board need not be removed. In other circumstances, often where the water levels were at or above drywall level, the drywall may also need to be removed.

Once the desired cement board(s) are removed, one or more portable blower fans and/or one or more dehumidifiers may be used to circulate air and dry the wall. For example, with reference to FIG. 13, once a cement board on a lower portion of a wall is removed, a portable blower fan may be provided and air may be blown at the wall to dry out the wall materials and also to remove any excess moisture above the water line or behind the drywall. A vertical rut in closed cell spray foam insulation as shown in FIG. 9 may help facilitate the flow of air upwards behind the remaining drywall, particularly in the circumstance where the vertical rut rises above the base of the drywall. In other circumstances, blown air may not be necessary and the building's air conditioning system, in optional conjunction with one or more portable humidifiers, may be sufficient to dry the wall materials.

Again, essentially the same principles may be applied to interior walls. But since interior walls typically have two sides, removal of the baseboards or lower paneling or molding, in conjunction with one or more cement boards, if required, may in some cases only need to happen on one side (although both sides may be removed if it seems appropriate). Opening only one side may allow sufficient airflow to dry the framing cavity, thereby reducing the reconstruction efforts.

A removed cement board (including those cases where rigid foam is sealed to or integral with the cement board) may be air dried in the same room or building, or may be taken outdoors or elsewhere to dry. In cases where removable rigid foam sheets are used, they may likewise be removed from the wall and/or cement board and dried in the same room or building, or may be taken outdoors or elsewhere to dry. Thereafter, the cement board and/or the rigid foam sheets may be replaced in the same (or different) locations on the wall, or reused on a different wall. Likewise, baseboards or paneling or lower molding may be reused in the same or different locations. Sometimes baseboard or paneling or lower molding may need to be replaced due to the effects of water (particularly in the case where water treatment of the base boards is not cost effective) or because it was damaged in post-flooding remediation.

In a preferred embodiment, a portable blower fan is used in conjunction with one or more dehumidifiers. This helps to maximize circulation while also helping to maximize the dryness of the air being circulated. In some circumstances where the cement board remains attached to the wall, portable blower fans may be placed far from a wall so as to blow air into several weepholes simultaneously, or so as to blow air across the full length of an air gap. In other circumstances, a portable blower fan may be placed in direct abutment with the cement board, or 1-3 inches from the cement board, so as to help maximize the velocity and volume of air being blown into the wall cavity.

Portable Blower Fan Adapter

Figure 20:
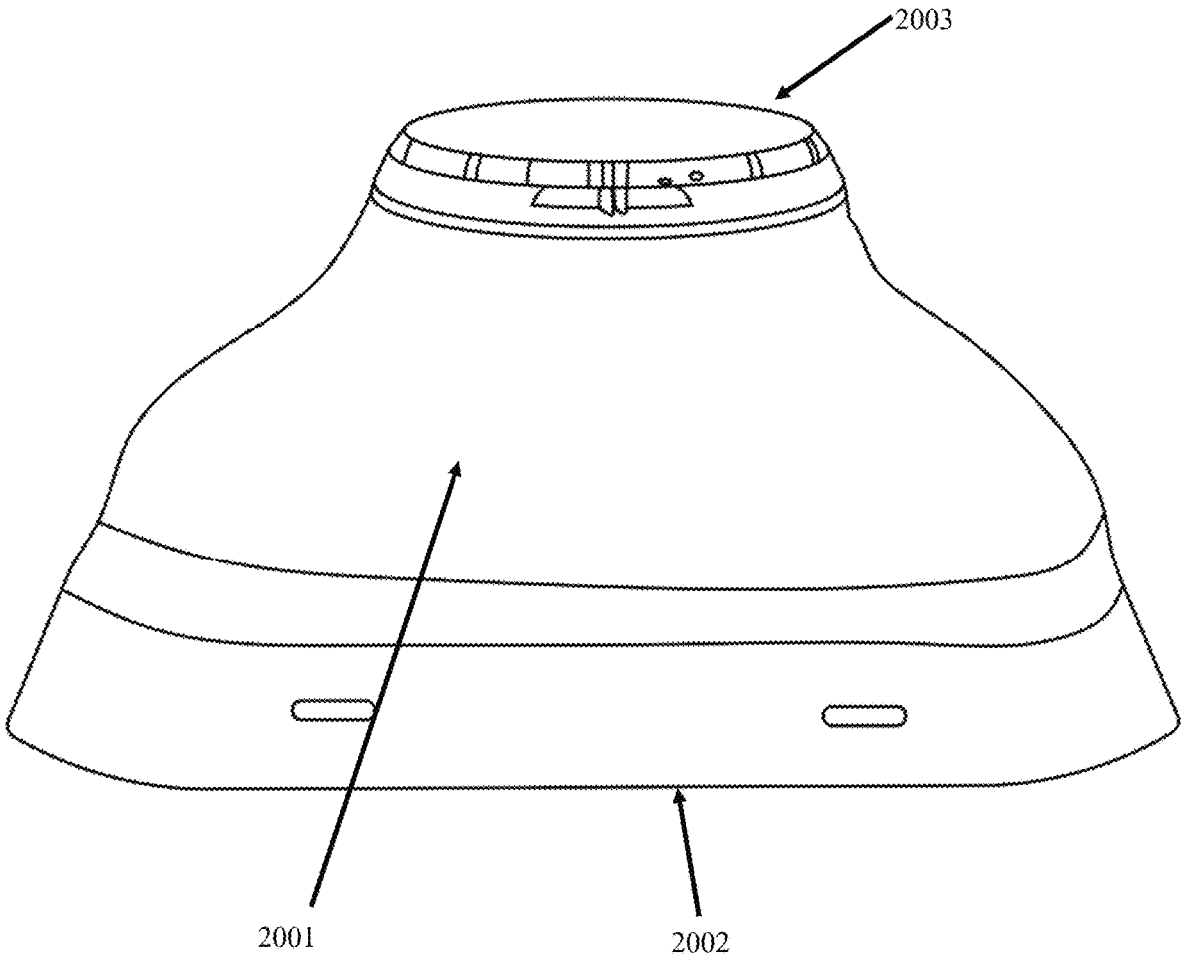
FIG. 20 depicts a portable fan blower adapter.
Figure 21:
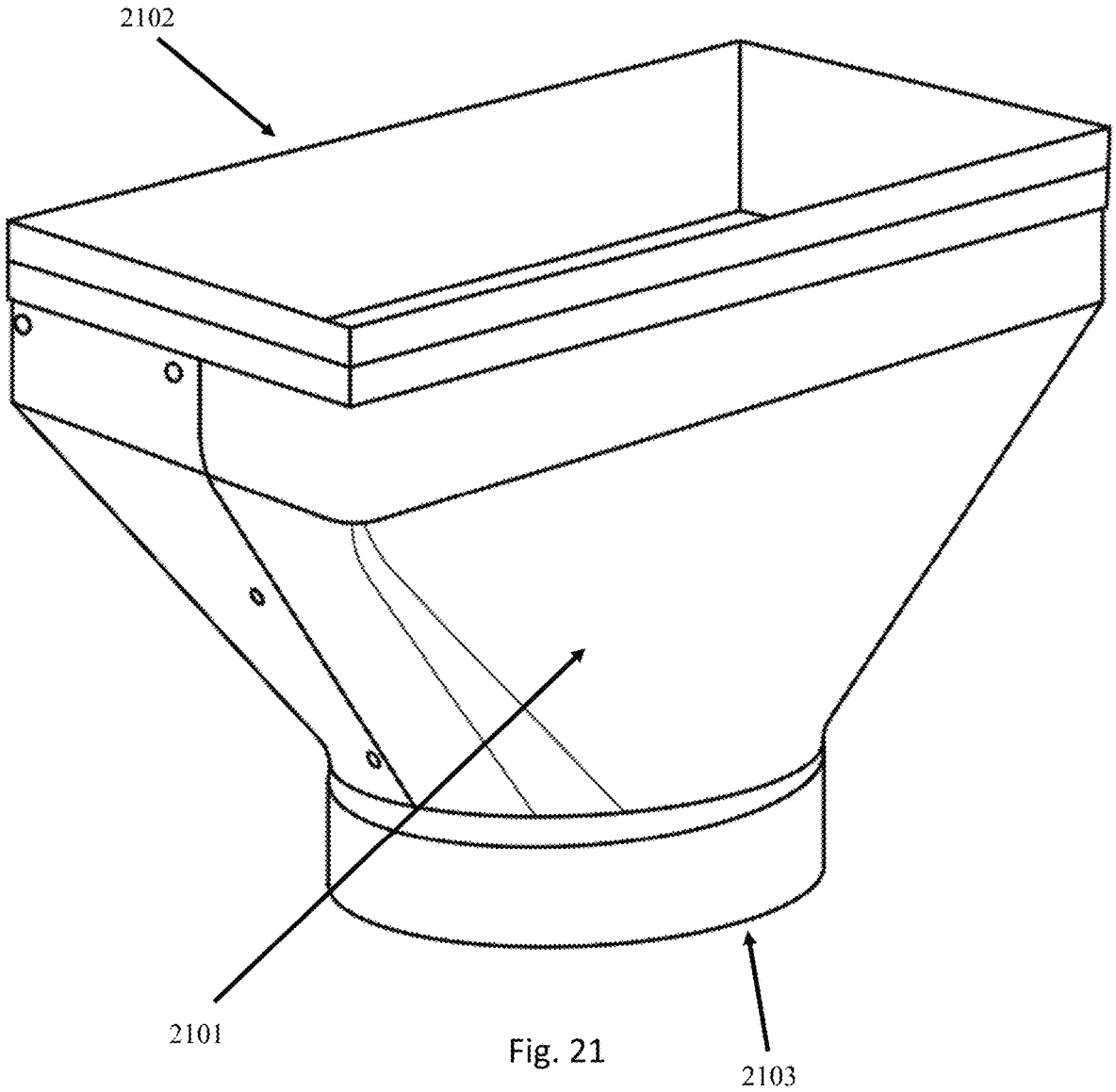
FIG. 21 depicts a wall adapter for use with a portable fan blower.

In another embodiment of the present invention, a portable fan blower attachment is used to facilitate the transfer or air from the portable blower fan into the wall cavity. In one embodiment, an oblong reducer (FIG. 20, 2001) is used to join a hose to the end of a portable fan blower with an oblong air exit (like that of the portable fan blower shown in FIG. 18). The reducer is attached on one end 2002 to the fan by, for example, integral molding, friction fit, interference fit, screws, or clamps. On the other end 2003 of the reducer, one end of a hose is attached by, for example, integral molding, friction fit, interference fit, screws, or clamps. The other end of a hose (not shown) attaches to a wall adapter as shown in FIG. 21, item 2101.

The wall adapter 2101 has a round hose connection on one end 2103 and a rectangular exit on the other end 2102. In some embodiments, the rectangular end 2102 of the wall adapter 2101 matches the approximate size of a weep hole (e.g., FIG. 11, item 1114) in a cement board so as to allow the wall adapter 2101 to provide a stream of air into a framing cavity while helping to minimize the loss of airflow sent towards other areas. In other embodiments, the rectangular end 2102 of the wall adapter 2101 matches a typical width of the space between studs of a framing cavity (e.g., 16 inches between the center of two weight bearing 2×4 studs yields approximately 14.5" of spacing between studs) as well as the air gap height.

For example, a wall adapter 2101 with a 14.5" nominal width and a 4" nominal height would slide into a the bottom of a framing cavity between the base plate and the bottom of the cement board (e.g., in the air gap FIG. 12, item 1216) so as to provide a stream of air into a framing cavity while helping to minimize the loss of airflow sent towards other areas. The wall adapter 2101 can be held in place on the wall by friction fit, interference fit, screws, nails, or clamps. The wall adapter may have a standardized size allowing it to fit a plurality of weepholes in a building, or across multiple buildings. The size of the wall adapter is generally a function of the preferred size of the weephole in the building. Some examples include might be 4×6 inches, 12×6 inches, 14.5×4 inches, generally spanning the range of 4-14.5 inches wide× 2-19.5 inches high. Typically, wider framing cavities may have a wider weephole, and buildings with higher peak flood water lines may desire higher weepholes. In some cases, the wall adapter simply better forms the airflow so as to maximize the airflow in the wall cavity.

While various embodiments of the present invention have been described above, it should be understood that they have been presented by way of example only, and not of limitation. Likewise, the various diagrams depict exemplary configurations for certain embodiments of the invention, which is done to aid in understanding the features and functionality that may be included physical embodiments or in actual implementations of the inventions herein. Thus, the breadth and scope of the present invention as claimed should not be limited by any of the above-described exemplary embodiments.

What is claimed is:

1. A wall of a building comprising:

two vertical framing studs;

a base plate under the two framing studs, the base plate and the two framing studs forming a bottom and two sides of a framing cavity;

closed cell spray foam insulation applied in the framing cavity, wherein the closed cell spray foam in the framing cavity comprises a vertical rut formed therein that begins at least one foot above the base plate and extends at least 6 inches downwards towards the base plate; and a cement board covering a portion of the framing cavity, wherein the lowest edge of the cement board is at least 1.0 (but no more than 16.0) inches above the top of the base plate and forms an air gap between the cement board and the base plate.

2. The wall of claim 1 wherein the lowest edge of the cement board is at least 2.0 inches above the base plate.

3. The wall of claim 1 wherein the depth of the vertical rut is between 1 and 3.0 inches.

4. The wall of claim 1 wherein a baseboard covers the air gap.

5. The wall of claim 1 comprising a furring strip between the cement board and at least one of the two framing studs.

6. The wall of claim 1 comprising a sheet of rigid closed cell foam covering at least a portion of the framing cavity.

7. A wall of a building comprising:

two vertical framing studs;

a base plate under the two framing studs, the base plate and the two framing studs forming a bottom and two sides of a framing cavity;

a cement board covering a portion of the framing cavity, wherein the lowest edge of the cement board is at least 1.0 inches above the top of the base plate and forms an air gap between the cement board and the base plate; and a sheet of rigid closed cell foam covering at least a portion of the framing cavity, wherein the lower edge of the sheet does not protrude into the air gap.

8. The wall of claim 7 wherein the lowest edge of the cement board is at least 4.0 inches above the base plate.

9. The wall of claim 7 comprising a furring strip between the cement board and at least one of the two framing studs.

10. The wall of claim 1 wherein the depth of the vertical rut is between 0.5 and 2.5 inches.

11. The wall of claim 7 wherein the sheet is permanently affixed to the cement board.

12. The wall of claim 7 comprising sheetrock vertically mounted above the cement board and covering a portion of the framing cavity.

13. A method of drying a wall of a building after a flooding event, wherein the wall comprises:

two vertical framing studs;

a base plate under the two framing studs, the base plate and the two framing studs forming a bottom and two sides of a framing cavity;

a cement board covering a portion of the framing cavity, wherein the lowest edge of the cement board is at least 1.0 inches above the top of the base plate and forms an air gap between the cement board and the base plate;

closed cell spray foam applied in the framing cavity, wherein the foam comprises a vertical rut that begins at least one foot above the base plate and extends downwards at least 6.0 inches towards the base plate, and wherein said vertical rut guides air blown by the blower fan up into the framing cavity; and the method of drying comprising:

providing a portable blower fan; and blowing air, using the portable blower fan, at the air gap.

14. The method of claim 13 further comprising:

removing a baseboard covering the air gap to permit more air blown by the blower fan to pass through the air gap.

15. The method of claim 14 further comprising:

reusing the baseboard to cover the air gap after the wall is dried.

16. The method of claim 13 wherein the depth of the vertical rut is between 1 and 3.0 inches.

17. The method of claim 13 wherein the wall further comprises a sheet of rigid closed cell foam insulation.

18. The method of claim 13 wherein the wall further comprises sheetrock vertically mounted above the cement board.

19. The method of claim 13 further including using a wall adapter in connection with a hose that is in connection with the portable blower fan to blow air at the air gap.

20. The method of claim 16 wherein the depth of the vertical rut is between 1.5 and 2.5 inches.

* * * * *